US008485523B2

(12) United States Patent
Kimura et al.

(10) Patent No.: US 8,485,523 B2
(45) Date of Patent: Jul. 16, 2013

(54) SHEET SORTER AND IMAGE FORMING APPARATUS

(75) Inventors: Masaharu Kimura, Osaka (JP); Norichika Katsura, Osaka (JP); Yasuaki Fukada, Osaka (JP); Haruhisa Furumoto, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 13/216,858

(22) Filed: Aug. 24, 2011

(65) Prior Publication Data

US 2012/0049441 A1 Mar. 1, 2012

(30) Foreign Application Priority Data

Aug. 25, 2010 (JP) ..... 2010-188711

(51) Int. Cl.
*B65H 31/26* (2006.01)

(52) U.S. Cl.
USPC ..... 271/220

(58) Field of Classification Search
USPC ..... 271/207, 220; 270/58.11
See application file for complete search history.

(56) References Cited

U.S. PATENT DOCUMENTS 5,037,081 A * 8/1991 Engelhardt et al. ..... 271/207
7,159,862 B2 * 1/2007 Matsutomo et al. ..... 271/3.14
7,665,730 B2 * 2/2010 Funada ..... 271/250
2002/0158405 A1 * 10/2002 Nagasako et al. ..... 271/213
2006/0071413 A1 4/2006 Kaneko et al.
2011/0140346 A1 * 6/2011 Fujita et al. ..... 271/110

FOREIGN PATENT DOCUMENTS

JP 01060564 A * 3/1989
JP 3-042460 A 2/1991
JP 8-119520 A 5/1996
JP 9-77339 A 3/1997
JP 2000-219397 A 8/2000
JP 2000-309468 A 11/2000
JP 2002-211814 A 7/2002
JP 2006-089201 A 4/2006
JP 2009-001395 A 1/2009

* cited by examiner

*Primary Examiner* — Prasad Gokhale
(74) *Attorney, Agent, or Firm* — Birch, Stewart, Kolasch & Birch, LLP

(57) ABSTRACT

A sheet sorter includes a sheet discharge tray, a sheet conveyance unit, and a sheet pressing guide. The sheet conveyance unit is configured to convey sheets in a conveyance direction and configured to be shifted in a shift direction along a sheet plane and in a shift direction that intersects the conveyance direction, so as to sort the sheets loaded onto the sheet discharge tray from the sheet conveyance unit. The sheet pressing guide is configured to contact and press the sheets, configured to move together with the sheet conveyance unit in conjunction with the sheet conveyance unit moving in the shift direction, and configured to contact a topmost sheet among the sheets loaded on the sheet discharge tray only at a downstream edge of the topmost sheet in the conveyance direction.

17 Claims, 15 Drawing Sheets

SHEET SORTER AND IMAGE FORMING APPARATUS

CROSS-REFERENCE TO RELATED APPLICATIONS

The present application claims priority under 35 U.S.C. §119(a) to Japanese Patent Application No. 2010-188711, filed Apr. 25, 2010. The contents of this application are herein incorporated by reference in their entirety.

BACKGROUND OF THE INVENTION

1. Field of the Invention

The present invention relates to a sheet sorter that can be employed in an image forming apparatus such as a printer, a copier, and a multifunction device, and to an image forming apparatus equipped with the sheet sorter.

2. Discussion of the Background

Conventionally known sheet sorters sort sheets of recording paper or the like, which are loaded onto a sheet discharge tray from a sheet conveyance unit that conveys the sheets, by shifting the sheet conveyance unit along the sheet plane and in a shift direction orthogonal to the conveyance direction of the sheets (for example, see JP3-42460A).

This sort of sheet sorter has the following disadvantage. With various types of sheets that are used, sheet conditions such as curling may result depending on the characteristics of the type of sheet. This can cause degradation of the stackability of the sheets when discharged onto the sheet discharge tray, meaning that there is a lack of uniformity in the sheets on the sheet discharge tray. Hence, it is not possible to reliably sort the sheets by differentiating between stacks of these sheets (offset sorting).

Furthermore, with a view to improving the stackability of sheets that are discharged onto the sheet discharge tray, it is conventionally known practice to provide a sheet pressing guide to contact the top face of the sheets that are loaded on the sheet discharge tray so as to press the sheets (for example, see JP8-119520A, JP9-77339A, and JP2002-211814A).

More specifically, JP8-119520A discloses that a contact portion of the paper press, which makes contact with the body of the discharge paper tray, is positioned such that only large-size discharged paper is held down.

Furthermore, JP9-77339A discloses a paper storage auxiliary mechanism that includes a first swinging member that makes contact with the forward end of the discharged paper to guide the discharged paper; and a second swinging member that has its one end swingably arranged at the other end of the first swinging member to hold down the paper that has been stacked on the discharge tray.

Furthermore, JP2002-211814A discloses a pair of guides rotationally movable in the vertical direction. One of the guide members is disposed in a dangling manner closer to the original discharge source than the other guide member, so that both guide members can press documents on the original discharge area at different positions.

As reflected in such related art, the following disadvantages are found in sheet sorters that shift a sheet conveyance unit, which conveys sheets, in a shift direction in sorting the sheets loaded onto a sheet discharge tray by the sheet conveyance unit, in cases where sheet pressing guides are provided to press the sheets loaded on the sheet discharge tray by contacting the top face of the sheets.

In such sheet sorters, in conjunction with the sheet conveyance unit moving in the shift direction, the sheet pressing guide moves together with the sheet conveyance unit (specifically, the sheet pressing guide is disposed on the sheet conveyance unit). When the sheet pressing guide comes into contact with the top face of the sheets loaded on the sheet discharge tray, this can lead to a situation in which, when the sheet conveyance unit shifts in the shift direction, the stacks of sheets stacked on the sheet discharge tray slip in the shift direction. This can disturb the offset sorting of the stacks of sheets.

FIGS. 15A to 15C are schematic side views, seen from a shift direction X, of a conventional sheet sorter in which a sheet pressing guide C1 is disposed on a sheet conveyance unit C2 and contacts a top face Pa of sheets P stacked on a sheet discharge tray C3. FIG. 15A shows a situation in which no sheets P are loaded on the sheet discharge tray C3. FIG. 15B shows a situation in which B5 size sheets P are stacked on the sheet discharge tray C3. FIG. 15C shows a situation in which A4 size sheets P are stacked on the sheet discharge tray C3.

FIGS. 16A to 16C are schematic side views, seen from a conveyance direction Y1, of the conventional sheet sorter in which the sheet pressing guide C1 is disposed on the sheet conveyance unit C2 and contacts the top face Pa of the sheets P stacked on a sheet discharge tray C3. FIG. 16A shows a situation in which no sheets P are loaded on the sheet discharge tray C3. FIG. 16B shows a situation in which the sheets P are stacked on the sheet discharge tray C3. FIG. 16C shows a situation in which the sheet conveyance unit C2 shifts in the shift direction X, causing the stack of sheets P stacked on the sheet discharge tray C3 to slip in the shift direction X, so that the offset sorting of the stacks of sheets P is disturbed.

With the conventional sheet sorter shown in FIGS. 15A to 15C and 16A to 16C, the sheet pressing guide C1 is disposed on the sheet conveyance unit C2, above the discharge opening C2*a* (see FIG. 15A and FIG. 16A), in the center of the sheet conveyance unit C2 in the shift direction X. This allows the sheet pressing guide C1 to move together with the sheet conveyance unit C2 in conjunction with movement of the sheet conveyance unit C2 in the shift direction X. Specifically, the sheet pressing guide C1 is rotationally movable, relative to the sheet conveyance unit C2, about an axis extending in the shift direction X, with the forward end of the sheet pressing guide C1 dangling toward the sheet discharge tray C3 under the weight of the sheet pressing guide C1 itself. Thus, the sheet pressing guide C1 contacts the top face Pa of the sheets P that are loaded on the sheet discharge tray C3, and holds down these sheets P.

For this reason, as shown in FIG. 16C, when the sheet pressing guide C1 moves together with the sheet conveyance unit C2 in conjunction with the sheet conveyance unit C2 moving in the shift direction X, this can lead to a situation in which, due to the contact between the sheet pressing guide C1 and the top face Pa of the sheets P loaded on the sheet discharge tray C3, the stacks of sheets P that are stacked on the sheet discharge tray C3 slip in the shift direction X, which can disturb the offset sorting of the stacks of sheets P.

It is an object of the present invention to provide a sheet sorter and an image forming apparatus equipped with the sheet sorter, which is capable of preventing disturbance of the offset sorting of stacks of sheets, even in cases where the sheet pressing guide moves together with the sheet conveyance unit in conjunction with the sheet conveyance unit moving in the shift direction, by preventing the movement in the shift direction of the stacks of sheets stacked on the sheet discharge tray.

SUMMARY OF THE INVENTION

With a view to solving the problems described above, the present invention was achieved based on the knowledge of the inventors that, when the sheet pressing guide moves together with the sheet conveyance unit in conjunction with the sheet conveyance unit moving in the shift direction, the smaller the contact area between the sheet pressing guide and the sheets that are loaded on the sheet discharge tray, the greater the extent to which the movement of the stacks of these sheets in the shift direction can be prevented. In order to minimize the contact area between the sheet pressing guide and the sheets, the position at which the sheet pressing guide contacts the sheets is limited to the area of the downstream edge (forward edge) of the sheets in the conveyance direction.

Specifically, according to one aspect of the present invention, a sheet sorter includes a sheet discharge tray, a sheet conveyance unit, and a sheet pressing guide. The sheet conveyance unit is configured to convey sheets in a conveyance direction and configured to be shifted in a shift direction along a sheet plane and in a shift direction that intersects the conveyance direction, so as to sort the sheets loaded onto the sheet discharge tray from the sheet conveyance unit. The sheet pressing guide is configured to contact and press the sheets, configured to move together with the sheet conveyance unit in conjunction with the sheet conveyance unit moving in the shift direction, and configured to contact a topmost sheet among the sheets loaded on the sheet discharge tray only at a downstream edge of the topmost sheet in the conveyance direction.

According to the one aspect of the present invention, the sheet pressing guide contacts the topmost sheet among the sheets loaded on the sheet discharge tray only at the downstream edge of the topmost sheet in the conveyance direction. This minimizes the contact area between the sheet pressing guide and the sheets loaded on the sheet discharge tray, and prevents movement in the shift direction of the stacks of sheets stacked on the sheet discharge tray even when the sheet pressing guide moves together with the sheet conveyance unit in conjunction with the sheet conveyance unit moving in the shift direction. This prevents disturbance of the offset sorting of the stacks of sheets.

In the above-described aspect of the present invention, the sheet pressing guide may have a forward end and a rear end in the conveyance direction. The rear end of the sheet pressing guide may be disposed so that the sheet pressing guide is swingable in a vertical direction relative to the sheet conveyance unit and so that the forward end of the sheet pressing guide dangles toward the sheet discharge tray under a weight of the sheet pressing guide itself.

According to this feature, the contact between the sheet pressing guide and the downstream edge of the topmost sheet loaded on the sheet discharge tray (specifically, the corner of a stack of sheets stacked on the sheet discharge tray) can be achieved with a simple configuration.

In the above-described aspect of the present invention, the sheet discharge tray may include a penetration portion configured to allow the forward end of the sheet pressing guide to penetrate into the sheet discharge tray below a loading face of the sheet discharge tray on which the sheets are loaded.

According to this feature, the sheet pressing guide is able to contact sheets of a long size in the conveyance direction at the downstream edge of the sheets. Additionally, the sheet pressing guide is able to contact sheets of a short size in the conveyance direction at the downstream edge of the sheets; the forward end of the sheet pressing guide penetrates into the penetration portion below the loading face. Consequently, even when multiple different sizes of sheets are used, the sheet pressing guide is able to contact varying sizes of sheets at the downstream edge of the sheets in the conveyance direction.

In the above-described aspect of the present invention, the penetration portion may include a groove or a through hole in the loading face of the sheet discharge tray. The at least one of the groove and the through hole may extend in the conveyance direction.

According to this feature, the penetration of the forward end of the sheet pressing guide below the loading face can be achieved with a simple configuration of a groove or a through hole disposed in the loading face of the sheet discharge tray and extending in the conveyance direction.

In the above-described aspect of the present invention, the groove or the through hole may have a width in the shift direction. The width may be greater than an amount of shift of the sheet conveyance unit plus a width of the forward end of the sheet pressing guide in the shift direction.

According to this feature, even when the sheet pressing guide moves together with the sheet conveyance unit in conjunction with the sheet conveyance unit moving in the shift direction, the forward end of the sheet pressing guide is able to move unimpeded in the shift direction within the groove or the through hole.

In the above-described aspect of the present invention, the forward end of the sheet pressing guide may be retractably extendable.

According to this feature, the sheet pressing guide with a shortened forward end is able to contact sheets of a short size in the conveyance direction at the downstream edge of the sheets. Additionally, in the case of sheets of a long size in the conveyance direction, an elongated forward end of the sheet pressing guide can be positioned further downstream in the conveyance direction than the downstream edge of these sheets. Consequently, even when multiple different sizes of sheets are used, the sheet pressing guide is able to contact varying sizes of sheets at the downstream edge of the sheets in the conveyance direction.

In the above-described aspect of the present invention, the forward end of the sheet pressing guide may be adjustable according to a size of a sheet discharged onto the sheet discharge tray.

According to this feature, the forward end of the sheet pressing guide is adjustable according to the size of a sheet discharged onto the sheet discharge tray. Consequently, when multiple different sizes of sheets are used, a user is able to understand to what extent the sheet pressing guide should be extended or retracted for any of the sizes of sheets, which allows for a corresponding increase in convenience.

In the above-described aspect of the present invention, the sheet pressing guide may include a swinging portion and an extension portion. The swinging portion may be swingable in the vertical direction relative to the sheet conveyance unit. The extension portion may be slidable in a direction of extension and retraction relative to the swinging portion. The extension portion may form a changeable angle in the vertical direction relative to the swinging portion.

According to this feature, even when multiple different sizes of sheets are used, the sheet pressing guide is able to contact varying sizes of sheets at the downstream edge of the sheets in the conveyance direction. Additionally, even if the angle formed between the sheet pressing guide and the sheet becomes small, the user can change the angle in the vertical direction of the extension portion relative to the swinging portion, thereby ensuring the contact between the sheet pressing guide and the downstream edge of the sheets, even with sheets of a long size in the conveyance direction.

In the above-described aspect of the present invention, the angle of the sheet pressing guide in the vertical direction may be automatically changed when the extension portion is extended.

According to this feature, the user is freed of adjustment of the angle in the vertical direction when the extension portion is extended.

According to another aspect of the present invention, an image forming apparatus includes the sheet sorter according to the above-described aspect of the present invention.

BRIEF DESCRIPTION OF THE DRAWINGS

FIG. 4A is a schematic plan view of the sheet sorter illustrating a situation in which a piece of paper P is discharged at a first shift end (movement end) in the shift direction; FIG. 4B is a schematic plan view of the sheet sorter illustrating a situation in which the piece of paper P is discharged at a second shift end (movement end) in the shift direction; FIG. 4C is a schematic cross-sectional view, seen from a shift direction, of a discharge roller shift unit illustrating the discharging of the piece of paper P at a point in time of the discharge roller shift unit reaching the first shift end or the second shift end in the shift direction; and FIG. 4D is a schematic plan view of the sheet sorter illustrating a positional relationship between a sorting width of the piece of paper P discharged onto the discharge tray and the discharge roller shift unit.

FIG. 5A shows a situation in which no paper P is loaded on the discharge tray; FIG. 5B shows a situation in which B5 size paper P is stacked on the discharge tray; and FIG. 5C shows a situation in which A4 size paper P is stacked on the discharge tray.

FIG. 6A shows a situation in which no paper P is loaded on the discharge tray; FIG. 6B shows a situation in which paper P is stacked on the discharge tray; and FIG. 6C shows a situation in which slipping in the shift direction of stacks of paper P stacked on the discharge tray is prevented, even when the discharge roller shift unit moves in the shift direction.

FIGS. 7A and 7B respectively show oval and circular sheet pressing guides in contact with the forward edge of the paper.

FIGS. 8A to 8C respectively show acute, obtuse, and right angled sheet pressing guides in contact with the forward edge of the paper.

FIG. 9A shows a situation in which no paper P is loaded on the discharge tray; FIG. 9B shows a situation in which B5 size paper P is stacked on the discharge tray; and FIG. 9C shows a situation in which A4 size paper P is stacked on the discharge tray.

FIG. 10A shows a situation in which no paper P is loaded on the discharge tray; FIG. 10B shows a situation in which paper P is stacked on the discharge tray; and FIG. 10C shows a situation in which slipping in the shift direction of stacks of paper P stacked on the discharge tray is prevented, even when the discharge roller shift unit moves in the shift direction.

FIG. 11A shows a situation in which no paper P is loaded on the discharge tray; FIG. 11B shows a situation in which B5 size paper P is stacked on the discharge tray; and FIG. 11C shows a situation in which B4 size paper P is stacked on the discharge tray.

FIG. 13A shows a situation in which no paper P is loaded on the discharge tray; FIG. 13B shows a situation in which B5 size paper P is stacked on the discharge tray; and FIG. 13C shows a situation in which A3 size paper P is stacked on the discharge tray.

FIG. 14A is a schematic side view, seen from the shift direction, of the third embodiment; FIG. 14B is a perspective view of the sheet pressing guide according to the third embodiment shown in FIG. 14A; and FIG. 14C is a perspective view of the swinging portion illustrating a configuration in which an angle changing portion, which is shown in FIG. 14B, is disposed along the swinging portion.

FIG. 15A shows a situation in which no sheets P are loaded on the sheet discharge tray; FIG. 15B shows a situation in which B5 size sheets P are stacked on the sheet discharge tray; and FIG. 15C shows a situation in which A4 size sheets P are stacked on the sheet discharge tray.

FIG. 16A shows a situation in which no sheets P are loaded on the sheet discharge tray; FIG. 16B shows a situation in which sheets P are stacked on the sheet discharge tray; and FIG. 16C shows a situation in which the sheet conveyance unit shifts in the shift direction, causing the stack of sheets P stacked on the sheet discharge tray to slip in the shift direction when the sheet conveyance unit moved in the shift direction, so that the offset sorting of the stacks of sheets P is disturbed.

DESCRIPTION OF THE INVENTION

Hereafter, embodiments of the present invention are described with reference to the drawings. It is noted that the embodiments set forth hereafter are examples in which the present invention has been reduced to practice, and are not intended to limit the technical scope of the present invention.

The General Configuration of the Image Forming Apparatus

Figure 1:
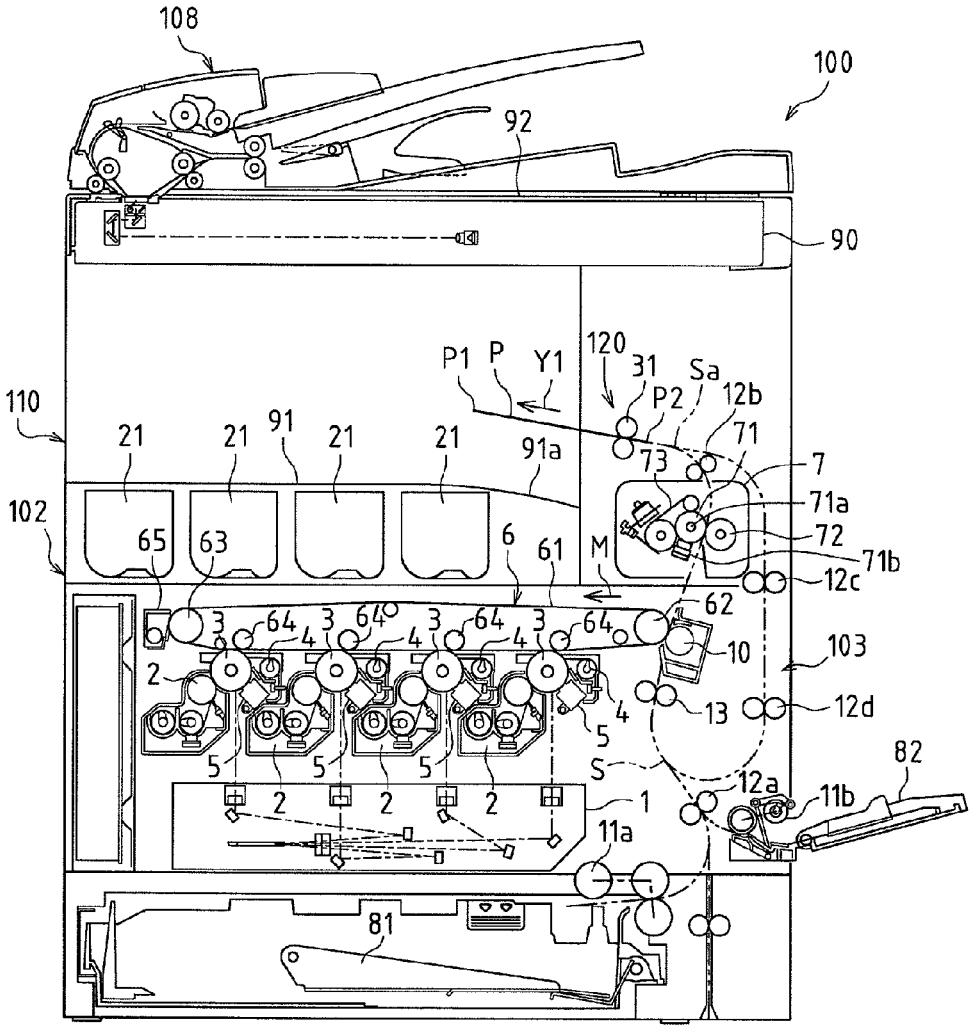
FIG. 1 is a schematic cross-sectional view, seen from the front, of an image forming apparatus equipped with a sheet sorter according to an embodiment of the present invention.

FIG. 1 is a schematic cross-sectional view, seen from the front, of an image forming apparatus 100 equipped with a sheet sorter 120 according to an embodiment of the present invention.

The image forming apparatus 100 shown in FIG. 1 is a color image forming apparatus that forms polychrome or monochrome images on sheets P such as recording paper (hereinafter referred to as paper) in accordance with image data transmitted to the image forming apparatus 100 from the exterior. The image forming apparatus 100 includes an original reading unit 108 and an apparatus main body 110. The apparatus main body 110 includes an image forming unit 102 and a sheet conveyance system 103.

The image forming unit 102 includes an exposure unit 1, a plurality of developer units 2, a plurality of photosensitive drums 3, a plurality of cleaning units 4, a plurality of charging units 5, an intermediate transfer belt unit 6, a plurality of toner cartridge units 21, and a fixing unit 7.

Furthermore, the sheet conveyance system 103 includes a paper feed tray 81, a manual paper feed tray 82, and a sheet discharge tray (hereinafter referred to as simply a discharge tray) 91.

At the top of the apparatus main body 110, an original stage 92 is disposed which is made of glass and on which an original (sheet) is to be placed. Below the original stage 92, an optical unit 90 for reading the original is disposed. The original reading unit 108 is disposed above the original stage 92. The original reading unit 108 automatically conveys originals onto the original stage 92. Furthermore, the original reading unit 108 is mounted on the apparatus main body 110 so as to be able to swing open at the front. As a result of exposing the original stage 92, originals can be placed there by hand.

The original reading unit 108 is able to read automatically conveyed originals or originals placed on the original stage 92. An overall image of the original read by the original reading unit 108 is sent to the apparatus main body 110 of the image forming apparatus 100 as image data, and in the apparatus main body 110, an image that is formed based on the image data is recorded on a piece of paper P.

The image data that is handled in the image forming apparatus 100 corresponds to a color image using multiple colors (in this case, black (K), cyan (C), magenta (M) and yellow (Y)). Accordingly, a plurality (four in this case, corresponding to black, cyan, magenta, and yellow) of developer units 2, photosensitive drums 3, cleaning units 4, charging units 5, and toner cartridge units 21 are established, so as to form a plurality of images (four images in this case) corresponding to the various colors, thus constituting a plurality (four in this case) image stations.

The charging units 5 are charging means for uniformly charging the surfaces of the photosensitive drums 3 to predetermined potentials, and instead of the charger type shown in FIG. 1, the charging units 5 can be of the roller type or the brush type, which are contact types.

The exposure unit 1 is configured as a laser scanning unit (LSU) that includes a laser emission unit and a reflecting mirror. The exposure unit 1 includes a polygonal mirror for scanning laser beams, and optical elements such as lenses and mirrors for conducting the laser light reflected by the polygonal mirror to the photosensitive drums 3. Otherwise, the exposure unit 1 may be implemented by, for example, techniques using write heads on which light emitting elements such as EL (electroluminescence) elements and LEDs (light emitting diodes) are arrayed.

The exposure unit 1 exposes the charged photosensitive drums 3 in accordance with the image data that has been input, so as to form electrostatic latent images on the surfaces of the photosensitive drums 3, in accordance with the image data.

The toner cartridge units 21 store toner and supply toner to the development tanks of the developer units 2. In the apparatus main body 110 of the image forming apparatus 100, supply of toner to the development tanks of the developer units 2 from the toner cartridge units 21 is controlled so that the toner concentration in the developer in the development tanks is constant.

The developer units 2 visualize the electrostatic latent image formed on the respective photosensitive drums 3, with the respective 4 colors (Y, M, C, K) of toner. Furthermore, the cleaning units 4 remove and recover the toner that remains on the surfaces of the photosensitive drums 3 after development and image transfer.

The intermediate transfer belt unit 6, which is disposed above the photosensitive drums 3, includes an intermediate transfer belt 61 that acts as an intermediate transfer body, an intermediate transfer belt drive roller 62, an intermediate transfer belt idler roller 63, a plurality of intermediate transfer rollers 64, and an intermediate transfer belt cleaning unit 65.

Four intermediate transfer rollers 64 are disposed corresponding to the colors Y, M, C, K. The intermediate transfer belt drive roller 62 tensions the intermediate transfer belt 61 together with the intermediate transfer belt idler roller 63 and the intermediate transfer rollers 64. Rotational driving of the intermediate transfer belt drive roller 62 circumferentially moves the intermediate transfer belt 61 in the direction of movement (the direction indicated by the arrow M in FIG. 1). In conjunction with this movement, the idler roller 63 and the intermediate transfer rollers 64 are rotated.

Transfer biases are applied to the intermediate transfer rollers 64 for the purpose of transferring the toner images formed on the photosensitive drums 3 to the intermediate transfer belt 61.

The intermediate transfer belt 61 contacts each of the photosensitive drums 3. To the intermediate transfer belt 61, the toner images in the colors formed on the photosensitive drums 3 are transferred by successively superimposing the toner images onto the intermediate transfer belt 61. This results in a color toner image (polychromatic toner image) formed on the surface of the intermediate transfer belt 61. The intermediate transfer belt 61 is of the endless type employing, for example, a film having a thickness of approximately 100 μm to 150 μm.

Transfer of the toner images from the photosensitive drums 3 to the intermediate transfer belt 61 is implemented by the intermediate transfer rollers 64, which contact the back of the intermediate transfer belt 61. To the intermediate transfer rollers 64, high-voltage transfer biases (high voltages with polarity (+) opposite to the charging polarity (−) of the toner) are applied for the purpose of transfer of the toner images. The intermediate transfer rollers 64 each include a base metal shaft (of stainless steel, for example) having a diameter of 8 mm to 10 mm, and the surface of the shaft is covered by an electrically conductive, elastic material (for example, EPDM (ethylene-propylene diene monomer rubber) or resin materials such as foamed urethane). The electrically conductive, elastic material makes the intermediate transfer rollers 64 transfer electrodes to apply a uniform high-voltage to the intermediate transfer belt 61. While in the embodiment the transfer electrodes are roller shaped transfer electrodes, brushes can be used as the transfer electrodes, instead of roller shaped transfer electrodes.

As has already been described, the toner images in the colors visualized on the photosensitive drum 3 are layered on the intermediate transfer belt 61. As a result of the circumferential movement of the intermediate transfer belt 61, the toner images layered on the intermediate transfer belt 61 are transferred onto the piece of paper P by a transfer roller 10 constituting a secondary transfer mechanism, which is disposed at a position of contact between the piece of paper P and the intermediate transfer belt 61. It is noted that the configuration of the secondary transfer mechanism is not limited to a transfer roller, and transfer configurations such as corona chargers and transfer belts can be used.

The transfer roller 10 and the intermediate transfer belt 61 define a transfer nip with a voltage (high voltage with a polarity (+) opposite to the charging polarity (−) of the toner) applied to the transfer roller 10 so as to implement transfer of the toner to the piece of paper P. The transfer nip between the transfer roller 10 and the intermediate transfer belt 61 is defined by pressing the transfer roller 10 and the intermediate transfer belt drive roller 62 against each other. In order to ensure a constant transfer nip, one of the transfer roller 10 and the intermediate transfer belt drive roller 62 is a hard roller made of a hard material (such as metal), while the other is an elastic roller made of a soft material (elastic rubber or a resin material such as a foamed resin).

In transferring the toner images onto the piece of paper P from the intermediate transfer belt 61 by the transfer roller 10, some toner may remain on the intermediate transfer belt 61, without being transferred onto the piece of paper P. Toner remaining on the intermediate transfer belt 61 results in toner color mixing in subsequent processes. For this reason, toner remaining on the intermediate transfer belt 61 is removed and recovered by the intermediate transfer belt cleaning unit 65. Specifically, the intermediate transfer belt cleaning unit 65 includes a cleaning member (for example, a cleaning blade) that contacts the intermediate transfer belt 61. The idler roller 63 supports the intermediate transfer belt 61 from the inside (backside), and the cleaning member is urged toward the idler roller 63 from the outside, so as to contact the intermediate transfer belt 61.

The paper feed tray 81 stores in advance paper P, on which the image is to be formed (printed). The paper feed tray 81 is disposed below the exposure unit 1 in the apparatus main body 110. In the manual paper feed tray 82, paper P on which the image is to be formed (printed) is placed. The discharge tray 91 is provided above the image forming unit 102 in the apparatus main body 110, and collects pieces of paper on which images are formed (printed) in the face-down state. The discharge tray 91 has a loading face 91*a* on which the piece of paper P is loaded and which has an upstream end in the conveyance direction (the direction indicated by the arrow Y1 in FIG. 1) lower than a downstream end.

Furthermore, the apparatus main body 110 includes a sheet transport path S through which paper P sent from the paper feed tray 81 and the manual paper feed tray 82 is delivered to the discharge tray 91, via the transfer roller 10 and the fixing unit 7. Disposed adjacent to the sheet transport path S are pickup rollers 11*a* and 11*b*, a plurality (in this case, first to fourth) of conveying rollers 12*a* to 12*d*, registration rollers 13, the transfer roller 10, a heat roller 71 and a pressure roller 72 in the fixing unit 7, and discharge rollers 31.

The first to fourth conveying rollers 12*a* to 12*d* are small rollers disposed along the sheet transport path S to advance and assist the conveyance of the piece of paper P. The pickup roller 11*a* is disposed adjacent to the paper feed end of the paper feed tray 81 to pick up a piece of paper P from the supply tray 81 on a one-by-one basis and supply the piece of paper P to the sheet transport path S. Likewise, the pickup roller 11*b* is disposed adjacent to the paper feed end of the manual paper feed tray 82 to pick up a piece of paper P from the manual paper feed tray 82 on a one-by-one basis and supply the piece of paper P to the sheet transport path S.

Furthermore, the registration rollers 13 temporarily holds a piece of paper P that is being conveyed through the sheet transport path S. The registration rollers 13 then conveys the piece of paper P to the transfer roller 10 at a timing such that the forward end of the toner image on the photosensitive drums 3 coincides with the downstream edge (hereinafter referred to as the forward edge) P1 of the piece of paper P in the conveyance direction Y1.

The fixing unit 7 fixes the unfused toner image on the piece of paper P and includes the heat roller 71 that serves as a fixing roller, and the pressure roller 72. The heat roller 71 is rotationally driven to rotationally drive the pressure roller 72, which is an idler, and to convey the piece of paper P while being held between the heat roller 71 and the pressure roller 72. The heat roller 71 is heated by a heater 71*a*, which is disposed at the interior of the heat roller 71, and maintained at a predetermined fixing temperature based on a signal from a temperature sensor 71*b*. Heated by the heater 71*a*, the heat roller 71 cooperates with the pressure roller 72 to thermally press the polychromatic toner image transferred to the piece of paper P so as to fix the image onto the piece of paper P. Thus, the polychromatic toner image is thermally fixed to the piece of paper P by fusing, mixing, and pressing. Furthermore, the fixing unit 7 includes an external heating belt 73 that heats the heat roller 71 from the exterior.

In the image forming apparatus 100 thus configured, when a request is made for simplex printing on a piece of paper P, a piece of paper P fed from the paper feed trays 81 and 82 is conveyed to the registration rollers 13 by the first conveying roller 12*a*, which is disposed along the sheet transport path S. The piece of paper P is then conveyed by the transfer roller 10 at a timing such that the forward edge P1 of the piece of paper P and the forward edge of the toner image on the intermediate transfer belt 61 are aligned, thus transferring the toner image onto the piece of paper P. The piece of paper P then passes through the fixing unit 7 to fuse and fix the unfused toner on the piece of paper P, and then is discharged onto the discharge tray 91 via the second conveying roller 12*b* and the discharge rollers 31.

When a request is made for duplex printing on a piece of paper P, after completion of the simplex printing with the piece of paper P past the fixing unit 7, the discharge rollers 31 rotate in reverse with the upstream edge (hereinafter referred to as the rear edge) P2 of the piece of paper P in the conveyance direction Y1 positioned between the discharge rollers 31 and a branching point Sa of the sheet transport path S. Thus, the piece of paper P is guided to the third and fourth conveying rollers 12*c* and 12*d*. Then, the piece of paper P is conveyed to the transfer nip via the registration rollers 13 to undergo printing on the back face, and is discharged to the discharge tray 91.

Sheet Sorter

The image forming apparatus 100 according to the embodiment includes a sheet sorter 120 that sorts paper P, which is discharged with the discharge rollers 31, by shifting the discharge rollers 31 in the axial direction of the discharge rollers 31.

Figure 2:
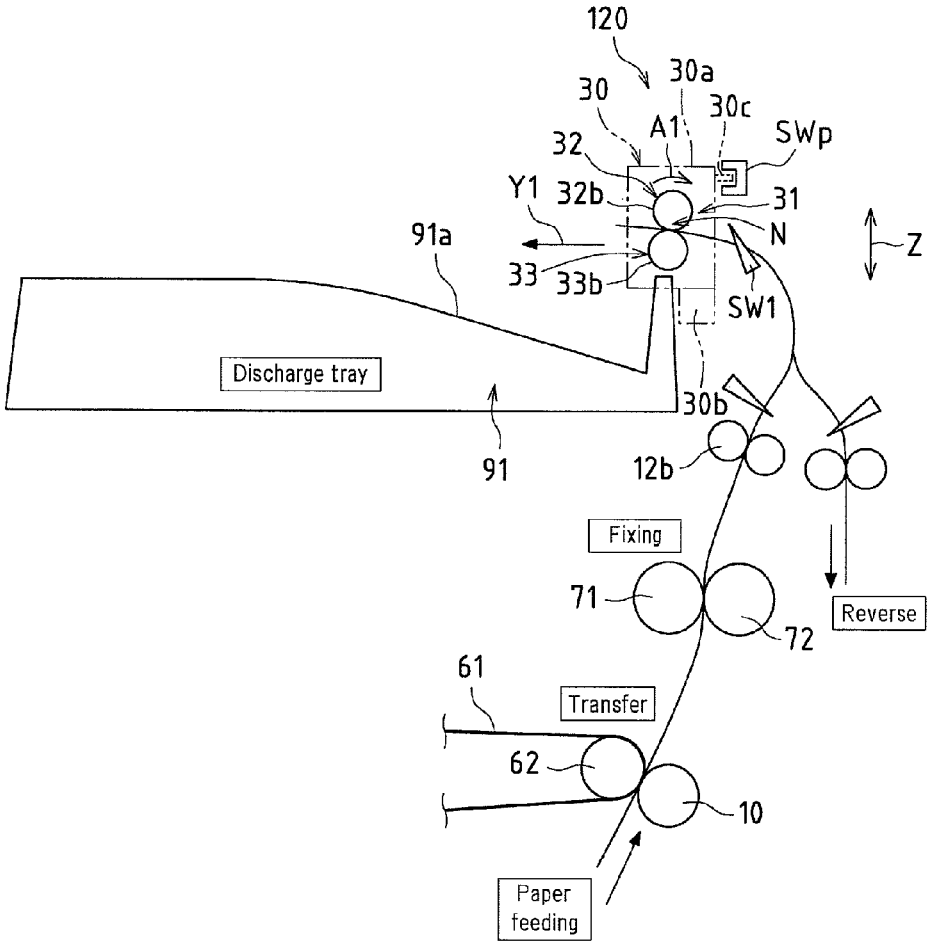
FIG. 2 is a schematic cross-sectional view of the sheet sorter according to the embodiment of the present invention, illustrating a discharge roller and parts adjacent to the discharge roller.
Figure 3:
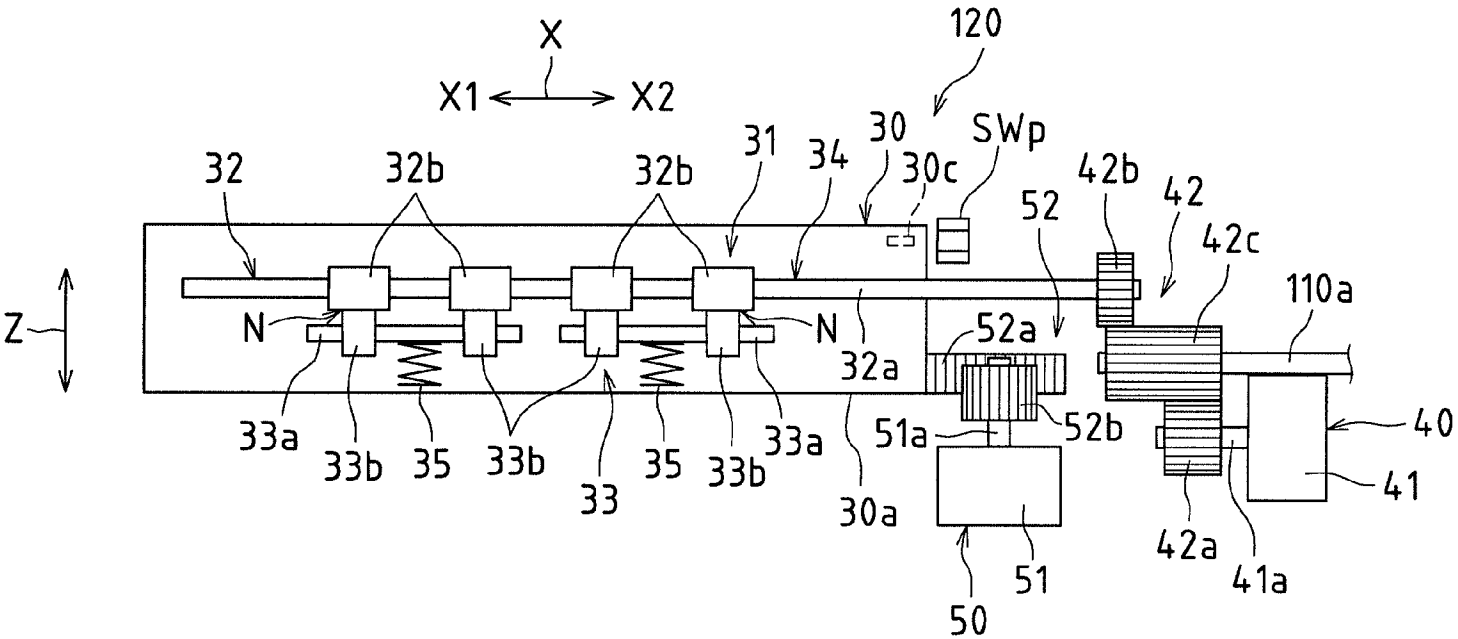
FIG. 3 is a schematic side view, seen from a paper discharge direction, of the sheet sorter according to the embodiment of the present invention, illustrating a sorting configuration.

FIG. 2 is a schematic cross-sectional view of the sheet sorter 120 according to the embodiment of the present invention, illustrating the discharge rollers 31 and parts adjacent to the discharge rollers 31. FIG. 3 is a schematic side view, seen from the conveyance direction Y1 of the piece of paper P, of the sheet sorter 120 according to the embodiment of the present invention, illustrating a sorting configuration.

As shown in FIGS. 2 and 3, the sheet sorter 120 includes: a discharge roller shift unit 30 (one example of a sheet conveyance unit) incorporating the discharge rollers 31; a rotary drive unit 40; a shift drive unit 50; and a discharge tray 91.

The discharge roller shift unit 30 is able to reciprocate in the axial direction of the discharge rollers 31 (in the direction indicated by the arrow X in FIG. 3, hereinafter referred to as the shift direction X) relative to the apparatus main body 110. In other words, the shift direction X is a direction along the paper plane and orthogonal to the conveyance direction Y1 of the piece of paper P. The discharge roller shift unit 30 is supported on the apparatus main body 110 by a slide member (specifically, a slide rail) 30*b* (see FIG. 2) that is able to reciprocate in the shift direction X. It is noted that the slide member 30*b* can have a conventionally known configuration, and thus a detailed description is not provided here.

Furthermore, a detection piece 30*c* that is detected by a position detection switch SWp is disposed on a main frame 30*a* of the discharge roller shift unit 30. The position detection switch SWp detects whether the discharge roller shift unit 30 is positioned in a reference position (specifically, a central position in the shift direction X (the normal position, at which sorting is not performed)). In this case, the position detection switch SWp is a transmission type optical sensor that detects the detection piece 30*c*, which is disposed on the main frame 30*a* of the discharge roller shift unit 30 (see FIGS. 2 and 3).

The discharge rollers 31 discharge pieces of paper P into the discharge tray 91 and, in this case, include a discharge roller pair 34 of a discharge drive roller 32 and discharge idler rollers 33.

More specifically, the discharge drive roller 32 includes a drive roller shaft 32*a* and a plurality (four in this case) of drive roller portions 32*b* coaxially fixed in place on the drive roller shaft 32*a*. The discharge idler rollers 33 include an idler roller shaft 33*a* and a plurality of idler roller portions 33*b* coaxially fixed in place on the idler roller shaft 33*a* and opposing the drive roller portions 32*b*. Furthermore, the discharge rollers 31 further include biasing members (in this case, coil springs) 35 for biasing the idler roller portions 33*b* toward the drive roller portions 32*b*.

The discharge roller pair 34 and the biasing members 35 are provided on the main frame 30*a* of the discharge roller shift unit 30. One end of the discharge drive roller 32 protrudes from the main frame 30*a* of the discharge roller shift unit 30, to the exterior in the shift direction X.

The drive roller shaft 32*a* of the discharge drive roller 32 is, in this case, unitary, and axially rotatable relative to the main frame 30*a* of the discharge roller shift unit 30.

In this case, a plurality (two in this case) of idler roller shafts 33*a* of the discharge idler rollers 33 are aligned in the shift direction X, and a plurality (two in this case) of idler roller portions 33*b* are fixed in place on each of the idler roller shafts 33*a*. To ensure that the idler roller portions 33*b* face the corresponding drive roller portions 32*b*, the idler roller shafts 33*a* are able to rotate axially and reciprocate vertically (the direction indicated by the arrow Z in the drawing) relative to the main frame 30*a* of the discharge roller shift unit 30. The discharge rollers 31 convey the piece of paper P through a nip portion N between the discharge drive roller 32 and the discharge idler rollers 33, where the piece of paper P is held between the discharge drive roller 32 and the discharge idler rollers 33 under the pressure of the discharge idler rollers 33.

Specifically, the biasing members 35 bias the discharge idler rollers 33 toward the discharge drive roller 32. In this case, the biasing members 35 are each disposed between an idler roller shaft 33*a* and a position on the main frame 30*a* of the discharge roller shift unit 30 opposite to the discharge drive roller 32. It is noted that the pressing force applied by the biasing members 35, with which to press the discharge idler rollers 33 against the discharge drive rollers 32, is of a degree that ensures suitable conveyance of the piece of paper P.

A rotary drive unit 40 rotationally drives the discharge rollers 31 and includes a conveying drive motor 41 (in this case, a stepping motor) and a drive transmission mechanism 42 that transmits the rotary drive from the conveying drive motor 41 to the discharge rollers 31.

The conveying drive motor 41 is disposed on the apparatus main body 110 so that a rotary shaft 41*a* is oriented in the shift direction X.

The drive transmission mechanism 42, in this case, is configured as a gear train in which a plurality of gears are arranged, and includes, in this case, a drive gear 42*a*, a roller gear 42*b*, and an intermediate gear 42*c*.

The drive gear 42*a* is coupled to the rotary shaft 41*a* of the conveying drive motor 41. The roller gear 42*b* is coupled to the end of the drive roller shaft 32*a* that protrudes from the main frame 30*a* of the discharge roller shift unit 30 to the exterior in the shift direction X. The intermediate gear 42*c* is rotatably supported on a rotary shaft 110*a*, which is fixed in place on the apparatus main body 110. The intermediate gear 42*c* is meshed with the drive gear 42*a* and the roller gear 42*b*. The drive gear 42*a*, the roller gear 42*b*, and the intermediate gear 42*c* each have gear teeth in the form of elongate protrusions and recesses that extend in the shift direction X. This ensures that the roller gear 42*b* slides in the shift direction X while being meshed with the intermediate gear 42*c*. The length of the intermediate gear 42*c* in the shift direction X is sufficient to allow the width of movement in the shift direction X of the discharge roller shift unit 30 (a length equivalent to the amount of shift and the gear meshing length combined). That is, the length ensures that the roller gear 42*b* will not disengage from the intermediate gear 42*c* when the discharge roller shift unit 30 reciprocates in the shift direction X.

The shift drive unit 50 shifts the discharge rollers 31 (in this case, the discharge roller shift unit 30) by driving the discharge rollers 31 in shift motion, and includes a shift drive motor 51 (in this case, a stepping motor) and a shift mechanism 52 that shifts the discharge roller shift unit 30.

The shift drive motor 51 is disposed on the apparatus main body 110 so that a rotary shaft 51*a* is oriented in a direction orthogonal to the shift direction X (in this case, the vertical direction Z).

The shift mechanism 52 includes, in this case, rack and pinion gears that convert rotational drive to linear drive; namely, a rack gear 52*a* that extends in the shift direction X and a cylindrical pinion gear 52*b*.

An end of the rack gear 52*a* in the shift direction X is coupled to an end of the discharge roller shift unit 30. The pinion gear 52*b* is coupled to the rotary shaft 51*a* of the shift drive motor 51, and meshed with the rack gear 52*a*. Consequently, the rotary shaft 51*a* of the shift drive motor 51 rotates in a first direction or a second direction to enable the discharge roller shift unit 30 to reciprocate in the shift direction X.

The conveying drive motor 41 is electrically coupled to an output system of a control unit (not shown) so as to receive a drive signal (ON signal) or a drive stop signal (OFF signal) from the control unit. The control unit transmits a rotation command signal that indicates the direction of rotation to the conveying drive motor 41 so as to drive the conveying drive motor 41, which in turn rotationally drives the first discharge rollers 31 in a first direction (the conveyance direction Y1) or a second direction (the direction opposite to the conveyance direction Y1). In the embodiment, when duplex printing is performed, another command is given to the conveying drive motor 41 to implement rotation in the direction opposite to a first direction A1. This, however, is not directly related to control of the sorting configuration of the image forming apparatus 100, and therefore, will not be described.

The shift drive motor 51 is electrically coupled to the output system of the control unit (not shown) so as to receive a drive signal (ON signal) or a drive stop signal (OFF signal) from the control unit. The control unit transmits a movement command signal to the shift drive motor 51. The movement command signal indicates rotation that causes the discharge roller shift unit 30 to move toward a first side in the shift direction X (toward the left side in FIG. 3, which is a shift direction X1), or indicates rotation that causes the discharge roller shift unit 30 to move toward a second side in the shift direction X (toward the right side in FIG. 3, which is a shift direction X2). The shift drive motor 51 is thereby pulse driven with reference to the reference position to drive the discharge roller shift unit 30 toward the first side, in a direction X1, or to the second side, in a direction X2.

With the sheet sorter 120 described above, the rotation command signal from the control unit drives the conveying drive motor 41 so that the drive power from the conveying drive motor 41 is transmitted to the drive transmission mechanism 42. This rotationally drives the discharge rollers 31 in the first direction A1. Furthermore, the movement command signal from the control unit drives the shift drive motor 51 so that the drive power from the shift drive motor 51 is transmitted to the shift mechanism 52. This discharge shifts the roller shift unit 30 to the first side, in the direction X1, or to the second side, in the direction X2.

Figure 4A:
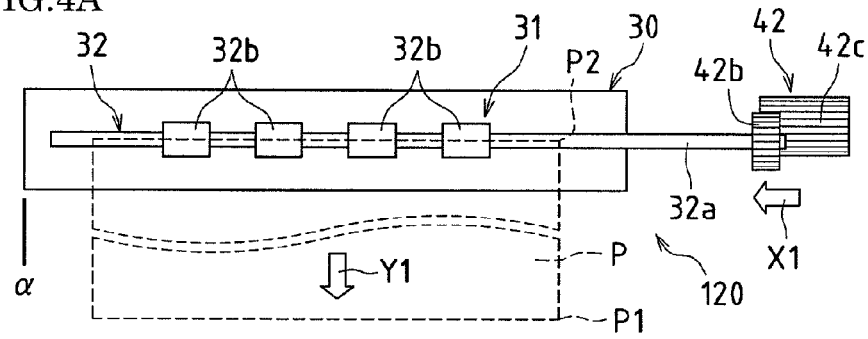
FIGS. 4A to 4D are diagrams illustrating a sorting operation of the sheet sorter according to the embodiment of the present invention.
Figure 4B:
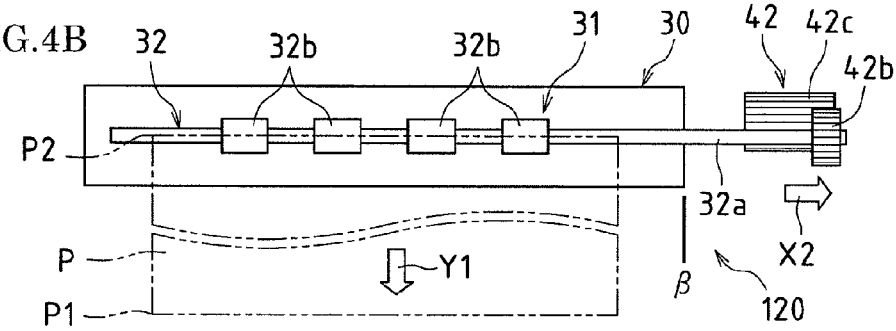
Figure 4C:
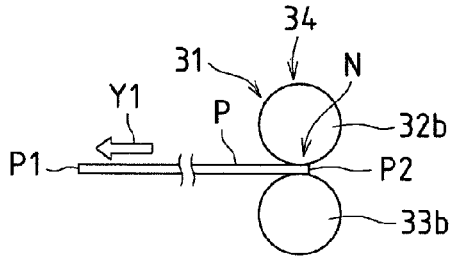
Figure 4D:
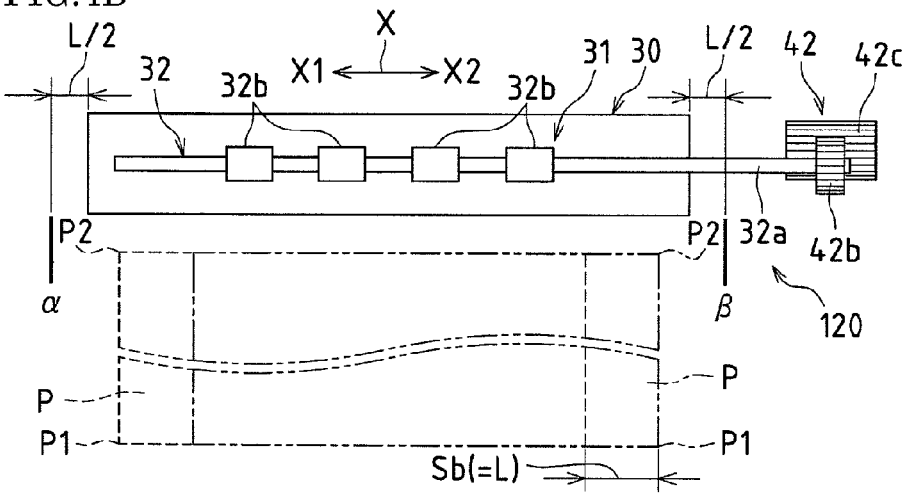

FIGS. 4A to 4D are diagrams illustrating a sorting operation of the sheet sorter 120 according to the embodiment of the present invention. FIG. 4A is a schematic plan view of the sheet sorter 120 illustrating a situation in which a piece of paper P is discharged at a first shift end (movement end) in the shift direction X. FIG. 4B is a schematic plan view of the sheet sorter 120 illustrating a situation in which the piece of paper P is discharged at a second shift end (movement end) in the shift direction X. FIG. 4C is a schematic cross-sectional view, seen from the shift direction X, of the discharge roller shift unit 30 illustrating the discharging of the piece of paper P at a point in time of the discharge roller shift unit 30 reaching the first shift end α or the second shift end β in the shift direction X. FIG. 4D is a schematic plan view of the sheet sorter 120 illustrating a positional relationship between a sorting width Sb of the piece of paper P discharged onto the discharge tray 91 and the discharge roller shift unit 30.

As shown in FIGS. 4A to 4D, when the piece of paper P is sorted at a first side (the left side in the drawing) or a second side (the right side in the drawing) in the shift direction X, a paper passage signal is input from the first detection switch SW1 (see FIG. 2), leading to an acknowledgement that the piece of paper P is held by the discharge rollers 31 (see FIG. 4C). Then, the discharge roller shift unit 30 begins moving toward the shift end on the first side in the shift direction X (see α in FIG. 4A) or toward the shift end on the second side in the shift direction X (see β in FIG. 4B). When the discharge roller shift unit 30 completes the shift movement to the first side shift end α or the second side shift end β (when the shift movement stops), the piece of paper P is discharged. The first detection switch SW1 detects whether the piece of paper P is passing through the discharge rollers 31 and is disposed, in this case, adjacent to the upstream side of the discharge rollers 31 in the conveyance direction Y1.

Thus, in the sorting operation with the sorting configuration shown in FIG. 3, the sorting width Sb (which is shown in FIG. 4D and 30 mm, specifically) of the piece of paper P discharged onto the discharge tray 91 is equal to the shift amount L (which is shown in FIG. 4D and 30 mm, specifically) of the discharge roller shift unit 30 in the shift direction X. It is noted that the discharge roller shift unit 30 moves to one side by L/2 from the central position in the shift direction X (the normal position when sorting is not performed), and that the shift amount L is a total of the amount of shift L/2 toward the first side combined and the amount of shift L/2 toward the second side.

Sheet Pressing Guide

As shown in FIGS. 5A to 5C and FIGS. 6A to 6C, the sheet sorter 120 according to the embodiment of the present invention includes a sheet pressing guide 300. It is noted that in FIG. 1 to FIGS. 4A through 4D, the sheet pressing guide 300 is not shown.

Figure 5A:
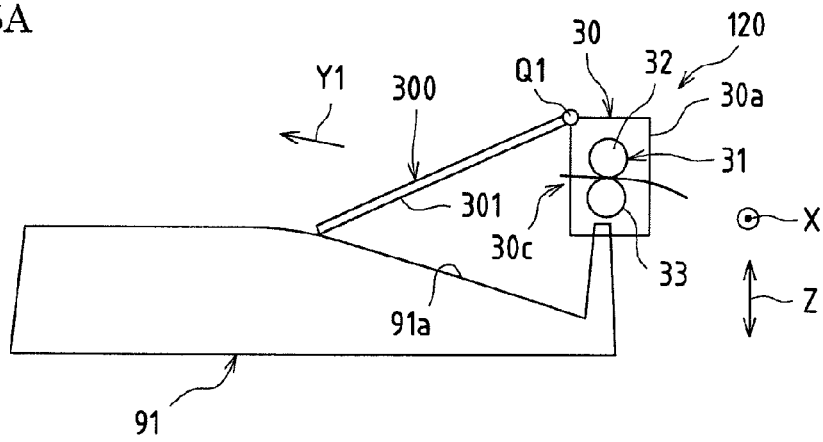
FIGS. 5A to 5C are schematic side views, seen from the shift direction, of the sheet sorter according to the embodiment of the present invention, illustrating a sheet pressing guide disposed on the discharge roller shift unit and parts adjacent to the sheet pressing guide.
Figure 5B:
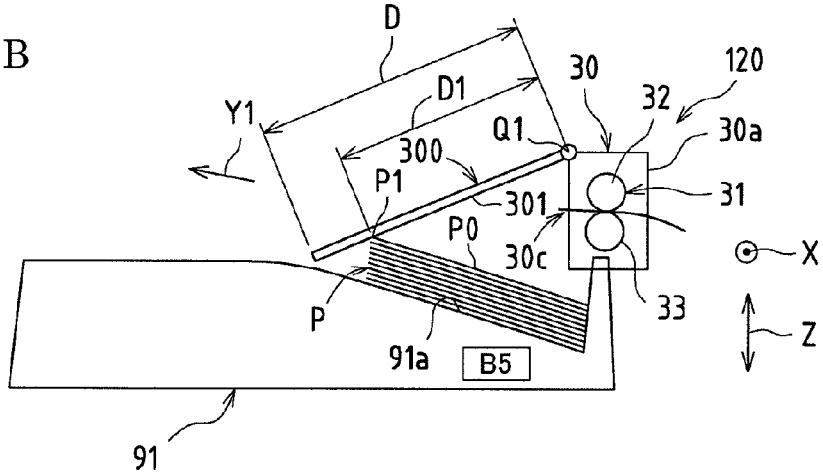
Figure 5C:
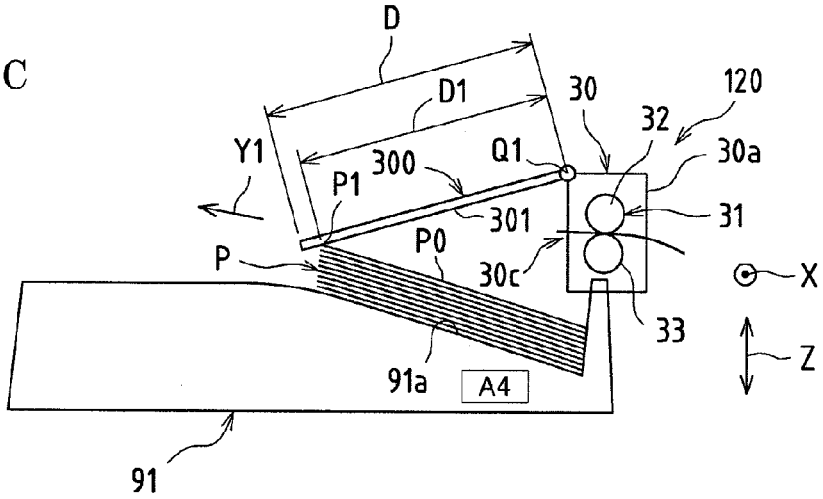
Figure 6A:
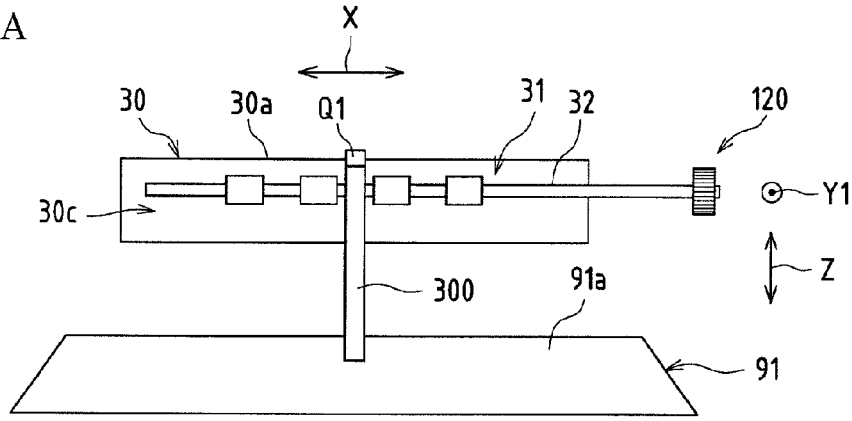
FIGS. 6A to 6C are schematic side views, seen from a conveyance direction, of the sheet sorter according to the embodiment of the present invention, illustrating the sheet pressing guide disposed on the discharge roller shift unit and parts adjacent to the sheet pressing guide.
Figure 6B:
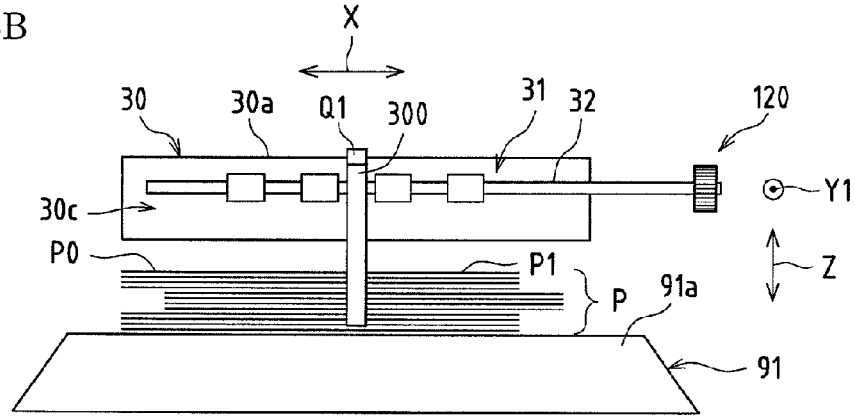
Figure 6C:
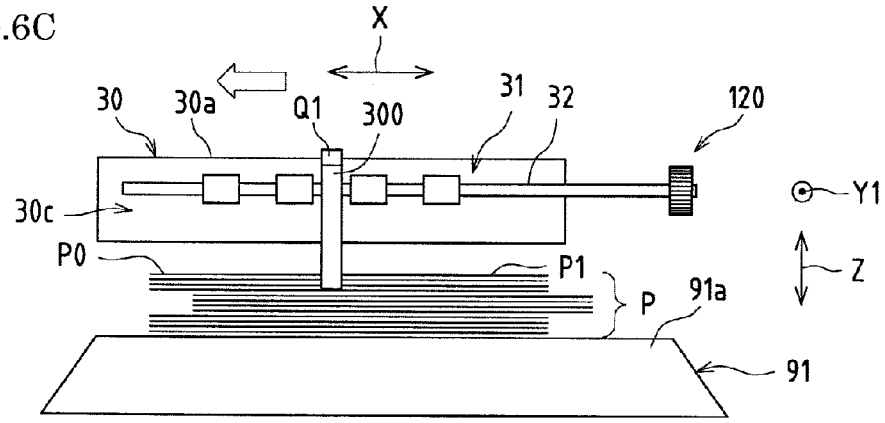

FIGS. 5A to 5C and FIGS. 6A to 6C are schematic side views of the sheet sorter 120 according to the embodiment of the present invention seen, respectively, from the shift direction X and the conveyance direction Y1, illustrating the sheet pressing guide 300 disposed on the discharge roller shift unit 30 and parts adjacent to the sheet pressing guide 300. FIG. 5A shows a situation in which no paper P is loaded on the discharge tray 91. FIG. 5B shows a situation in which B5 size paper P is stacked on the discharge tray 91. FIG. 5C shows a situation in which A4 size paper P is stacked on the discharge tray 91. FIG. 6A shows a situation in which no paper P is loaded on the discharge tray 91. FIG. 6B shows a situation in which paper P is stacked on the discharge tray 91. FIG. 6C shows a situation in which slipping in the shift direction X of stacks of paper P stacked on the discharge tray 91 is prevented, even when the discharge roller shift unit 30 moves in the shift direction X. It is noted that in FIGS. 6A to 6C, the discharge idler rollers 33 and like elements are not shown.

The sheet pressing guide 300 contacts a piece of paper P loaded on the discharge tray 91 to press the piece of paper P. The sheet pressing guide 300 also functions to ensure that pieces of paper P shooting out of the discharge roller shift unit 30 fall down stably.

The sheet pressing guide 300 is disposed at the top of the discharge opening 30*c* of the discharge roller shift unit 30 and at the center of the discharge roller shift unit 30 in the shift direction X. Consequently, in conjunction with the discharge roller shift unit 30 moving in the shift direction X, the sheet pressing guide 300 moves together with the discharge roller shift unit 30.

In the sheet sorter 120, the sheet pressing guide 300 only contacts a forward edge P1 of a topmost sheet P0 of paper P loaded on the discharge tray 91 (specifically, the corner of a stack of pieces of paper P aligned to the same dimension in the conveyance direction Y1).

According to the embodiment, the sheet pressing guide 300 only contacts the topmost piece P0 of paper P loaded on the discharge tray 91 at the forward edge P1, thereby minimizing the contact area between the sheet pressing guide 300 and the piece of paper P loaded on the discharge tray 91. This prevents the movement in the shift direction X of the stacks of paper P stacked on the discharge tray 91, even when the sheet pressing guide 300 moves together with the discharge roller shift unit 30 in conjunction with the discharge roller shift unit 30 moving in the shift direction X. As a result, disturbance of the offset sorting of the stacks of paper P is prevented. It is noted that while B5 size paper P and A4 size paper P are used in FIGS. 5B, 5C, 6B, and 6C, it is a matter of course that any size of paper P can be used.

The rear end of the sheet pressing guide 300 is disposed so that the sheet pressing guide 300 is swingable in the vertical direction Z relative to the discharge roller shift unit 30. In this case, the sheet pressing guide 300 is rotatable about an axis oriented in the shift direction X (specifically, rotatable about a rotation shaft Q1 that is disposed on the discharge roller shift unit 30 and oriented in the shift direction X). The forward end of the sheet pressing guide 300 dangles toward the discharge tray 91 under the weight of the sheet pressing guide 300 itself. Hence, if there is no paper P in the discharge tray 91 (see FIGS. 5A and 6A), the forward end of the sheet pressing guide 300 contacts the discharge tray 91. This only requires a simple configuration to bring the sheet pressing guide 300 into contact with the forward edge P1 of the topmost piece P0 of paper P loaded on the discharge tray 91 (specifically, the corner of a stack of paper P).

More specifically, the sheet pressing guide 300 is a narrow elongate flat or rod-shaped member (a flat member in the illustrated examples) having a length D (see FIGS. 5B and 5C) that is longer than a distance D1 from the rear end of the sheet pressing guide 300 (specifically, the rotation shaft Q1 at the rear end) to the forward edge P1 of the topmost piece P0 of paper P loaded on the discharge tray 91 (see FIGS. 5B and 5C). It is noted that while the distance D1 may vary according to the stacking height of the paper P loaded on the discharge tray 91, the length D of the sheet pressing guide 300 is longer than the maximum of the distance D1, which may vary according to the stacking height of the paper P.

In the embodiment, the sheet pressing guide 300, which is a narrow elongate flat member, has a planer bottom face 301 that comes into contact with the forward edge P1 of the topmost piece P0 of paper P. This, however, should not be construed in a limiting sense; for example, as shown in FIGS. 7A, 7B, and 8A to 8C, at least the portion of the sheet pressing guide 300 that contacts the forward edge P1 of the topmost sheet P0 of paper P may have a curved shape or an angular shape.

Figure 7A:
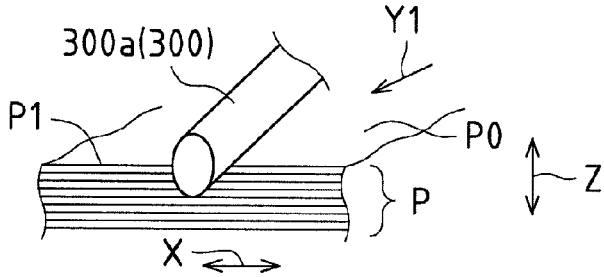
FIGS. 7A and 7B are schematic perspective views of the sheet pressing guide illustrating exemplary curved shapes at least for the portion of the sheet pressing guide that contacts the forward edge of paper.
Figure 7B:
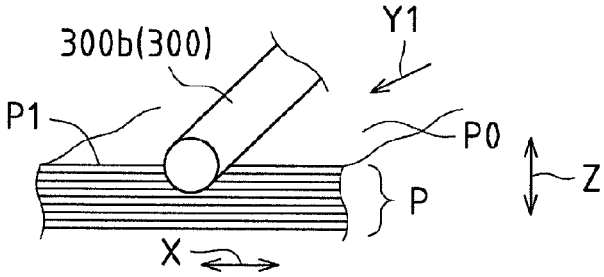

FIGS. 7A and 7B are schematic perspective views of the sheet pressing guide 300 illustrating exemplary curved shapes at least for the portion of the sheet pressing guide 300 that contacts the forward edge P1 of the topmost sheet P0 of paper. FIGS. 7A and 7B respectively show oval and circular sheet pressing guides 300*a* and 300*b* in contact with the forward edge P1 of the topmost sheet P0 of paper P.

The sheet pressing guide 300*a* (300) shown in FIG. 7A is an oval cylindrical member as seen in a cross-section with its major axis oriented in the vertical direction Z. The sheet pressing guide 300*b* (300) shown in FIG. 7B is a circular cylindrical member as seen in a cross-section.

Figure 8A:
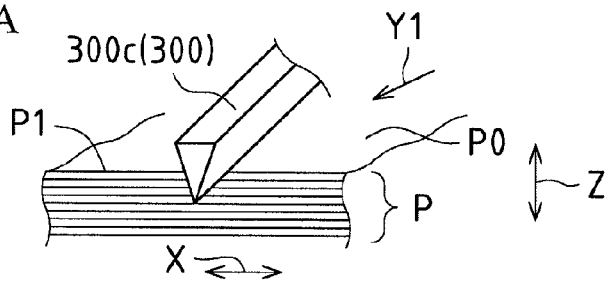
FIGS. 8A to 8C are schematic perspective views of the sheet pressing guide illustrating exemplary angular shapes at least for the portion of the sheet pressing guide that contacts the forward edge of paper.
Figure 8B:
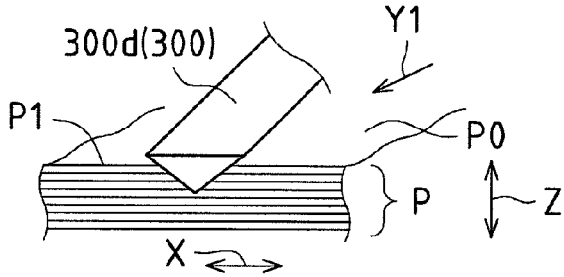
Figure 8C:
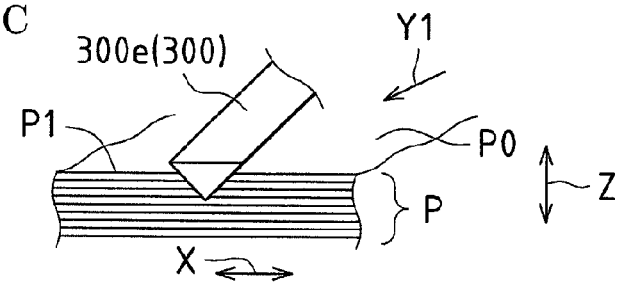
Figure 9A:
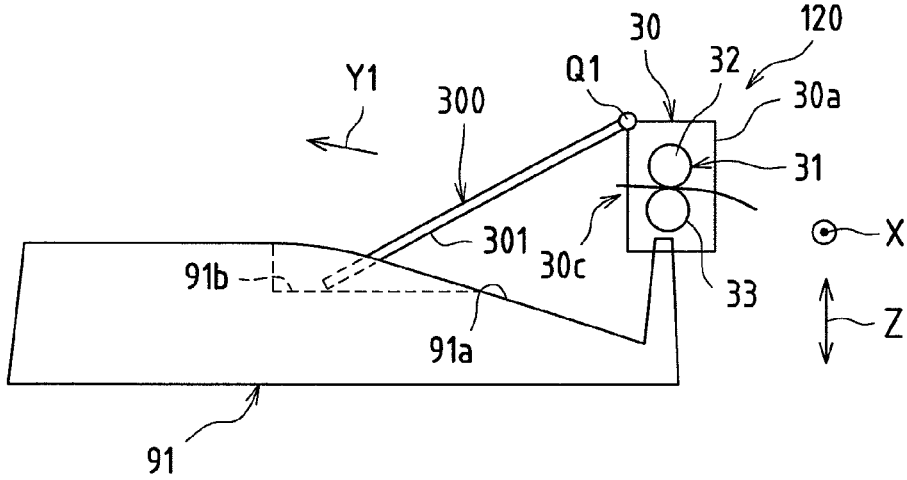
FIGS. 9A to 9C are schematic side views, seen from the shift direction, of a first embodiment wherein the discharge tray includes a penetration portion in the configuration shown in FIGS. 5A to 5C.
Figure 9B:
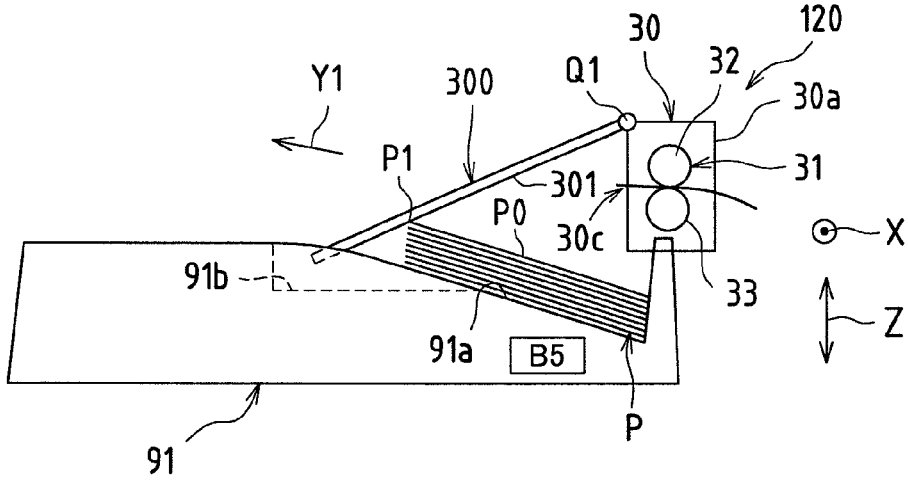
Figure 9C:
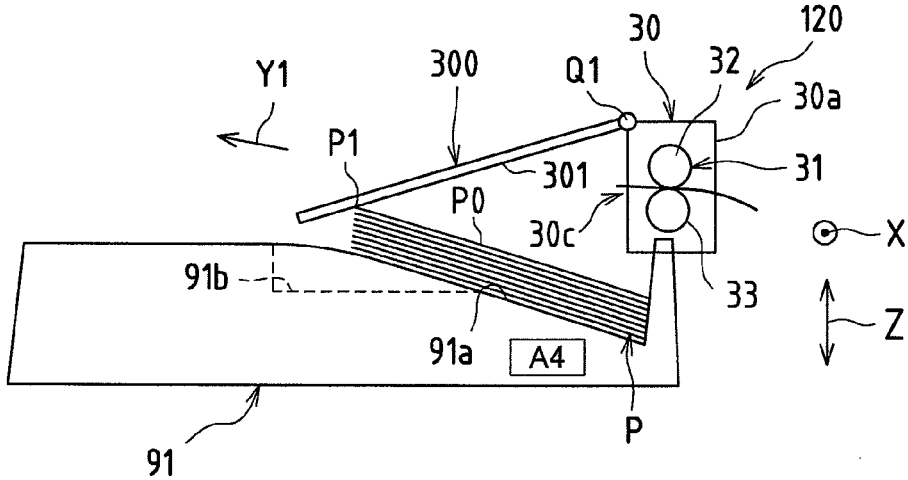

FIGS. 8A to 8C are schematic perspective views of the sheet pressing guide 300 illustrating exemplary angular shapes at least for the portion of the sheet pressing guide 300 that contacts the forward edge P1 of the topmost sheet P0 of paper P. FIGS. 8A to 8C respectively show acute, obtuse, and right angled sheet pressing guides 300*c* to 300*e* in contact with the forward edge P1 of the topmost sheet P0 of paper P.

The sheet pressing guide 300*c* (300) shown in FIG. 8A has an acute-angled corner that contacts the forward edge P1 of the topmost sheet P0 of paper P. The sheet pressing guide 300*d* (300) shown in FIG. 8B has an obtuse-angled corner that contacts the forward edge P1 of the topmost sheet P0 of paper P. The sheet pressing guide 300*e* (300) shown in FIG. 8C has a right-angled corner that contacts the forward edge P1 of the topmost sheet P0 of paper P.

Each configuration shown in FIGS. 7A, 7B, and 8A to 8C ensures a point contact between the sheet pressing guide 300 and the topmost piece P0 of paper P loaded on the discharge tray 91. This minimizes the contact area between the sheet pressing guide 300 and the piece of paper P0.

Incidentally, when multiple different sizes of paper P are used such as B5, A4, and B4, the following situations are possible. Whereas the sheet pressing guide 300 can contact the forward edge P1 of a piece of paper P of a long size in the conveyance direction Y1 (for example, A4 size), the sheet pressing guide 300 completely cannot contact a piece of paper P of a short size in the conveyance direction Y1 (for example, B5 size). This is because the end of the sheet pressing guide 300 on the side of the forward edge P1 of such piece of paper P contacts the loading face 91*a* of the discharge tray 91, thereby preventing a further downward movement of the sheet pressing guide 300. Meanwhile, whereas the sheet pressing guide 300 can contact the forward edge P1 of a piece of paper P of a short size in the conveyance direction Y1 (for example, B5 size), the bottom face 301 of the guide 300 cannot contact the forward edge P1 of a piece of paper P that is long in the conveyance direction Y1 (for example, A4 size), because the forward end of the guide member 300 contacts the top face of the piece of paper P. In view of these situations, the sheet sorter 120 according to the embodiment may be configured as in first and second embodiments.

First Embodiment

In the first embodiment, as shown in FIGS. 9A to 9C and 10A to 10C, the loading tray 91 includes a penetration portion 91*b* that allows the forward end of the sheet pressing guide 300 to penetrate below the loading face 91*a*.

FIGS. 9A to 9C and 10A to 10C show the first embodiment wherein the penetration portion 91*b* is disposed in the discharge tray 91 in the configuration shown in FIGS. 5A to 5C and 6A to 6C.

By providing a penetration portion 91*b* that allows the forward end of the sheet pressing guide 300 to penetrate below the loading face 91*a* of the loading tray 91 in this manner, the sheet pressing guide 300 is able to contact the forward edge P1 (see FIG. 9C) of a piece of paper P of a long size in the conveyance direction Y1 (in this example, A4 size). Additionally, the sheet pressing guide 300 is able to contact the forward edge P1 of a piece of paper P of a short size in the conveyance direction Y1 (in this example, B5 size), since the end of the sheet pressing guide 300 on the side of the forward edge P1 of such piece of paper P penetrates into the penetration portion 91*b* below the loading face 91*a* (see FIG. 9B). Consequently, even when multiple different sizes of paper P are used, the sheet pressing guide 300 is able to contact the topmost piece P0 of varying sizes of paper P only at the forward edge P1.

More specifically, the penetration portion 91*b* is a groove or a through hole (a groove in the example shown in the drawing) extending in the conveyance direction Y1, and is disposed in the loading face 91*a* of the discharge tray 91.

Thus, penetrating the forward end of the sheet pressing guide 300 below the loading face 91*a* can be implemented with a simple configuration, such as by providing a groove or through hole extending in the conveyance direction Y1 in the loading face 91*a* of the discharge tray 91. It is noted that the penetration portion 91*b* may be disposed through to the downstream end of the discharge tray 91 in the conveyance direction Y1, or the penetration portion 91*b* may be disposed in a range that accommodates the sheet pressing guide 300 in the conveyance direction Y1. In this case, the penetration portion 91*b* is disposed in a range that accommodates the sheet pressing guide 300 in the conveyance direction Y1.

Figure 10A:
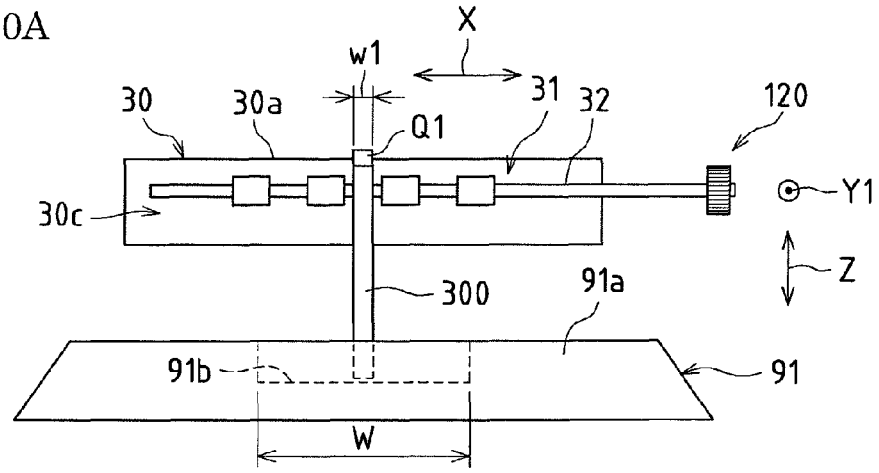
FIGS. 10A to 10C are schematic side views, seen from the conveyance direction, of the first embodiment wherein the discharge tray includes a penetration portion in the configuration shown in FIGS. 6A to 6C.
Figure 10B:
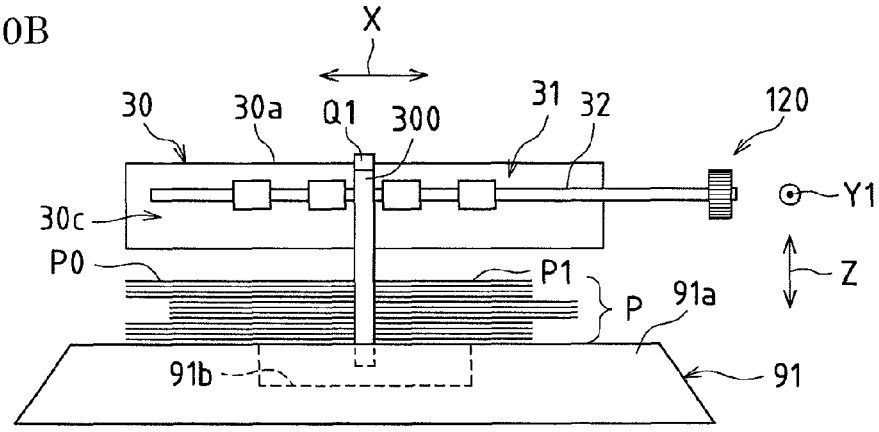
Figure 10C:
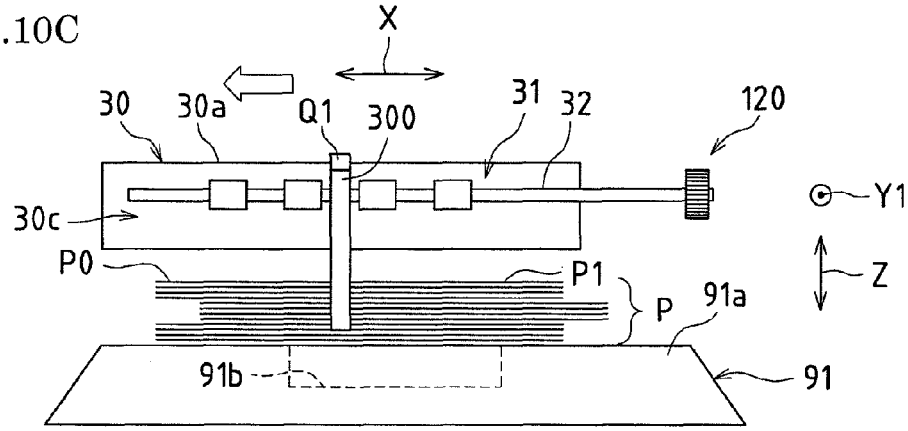

The width W (see FIG. 10A) in the shift direction X of the penetration portion 91*b*, which takes the form of a groove or a through hole, is greater than the amount of shift L of the discharge roller shift unit 30 (see FIG. 4D) plus the width W1 of the forward end of the sheet pressing guide 300 in the shift direction X (see FIG. 10A). Consequently, even when the sheet pressing guide 300 moves together with the discharge roller shift unit 30 in conjunction with the discharge roller shift unit 30 moving in the shift direction X, the forward end of the sheet pressing guide 300 is able to move in the shift direction X unimpeded in the penetration portion 91*b*, which takes the form of a groove for a through hole.

Second Embodiment

In the second embodiment, the forward end of the sheet pressing guide 300 is retractably extendable.

Figure 11A:
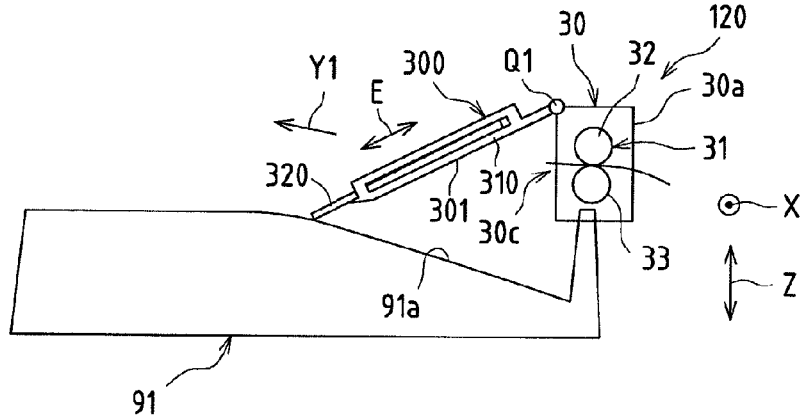
FIGS. 11A to 11C are schematic side views, seen from the shift direction, of a second embodiment wherein the forward end of the sheet pressing guide is retractably extendable.
Figure 11B:
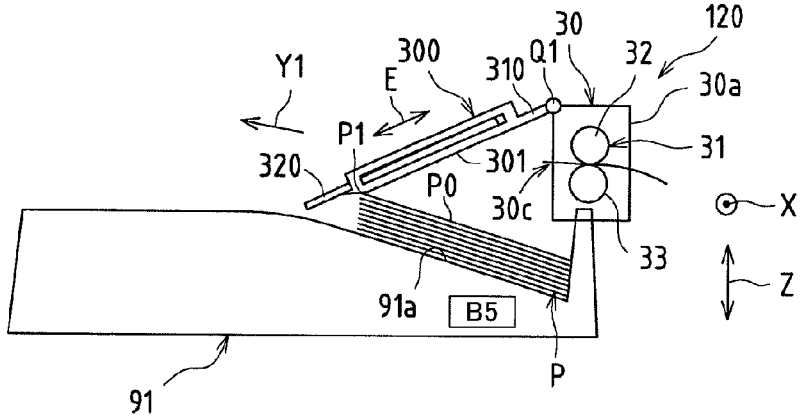
Figure 11C:
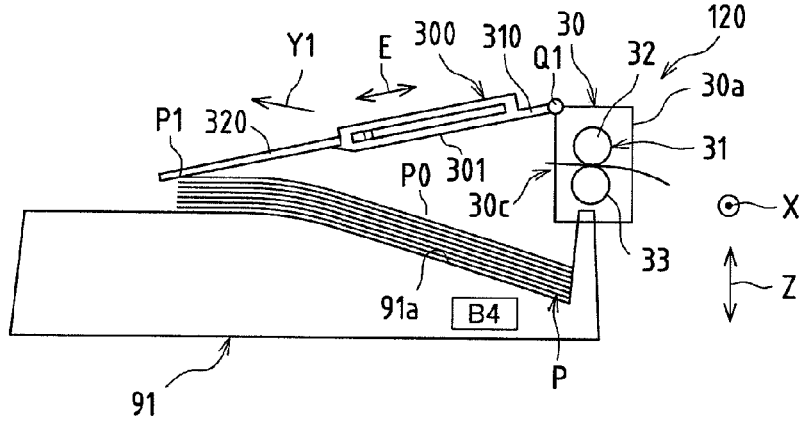
Figure 12:
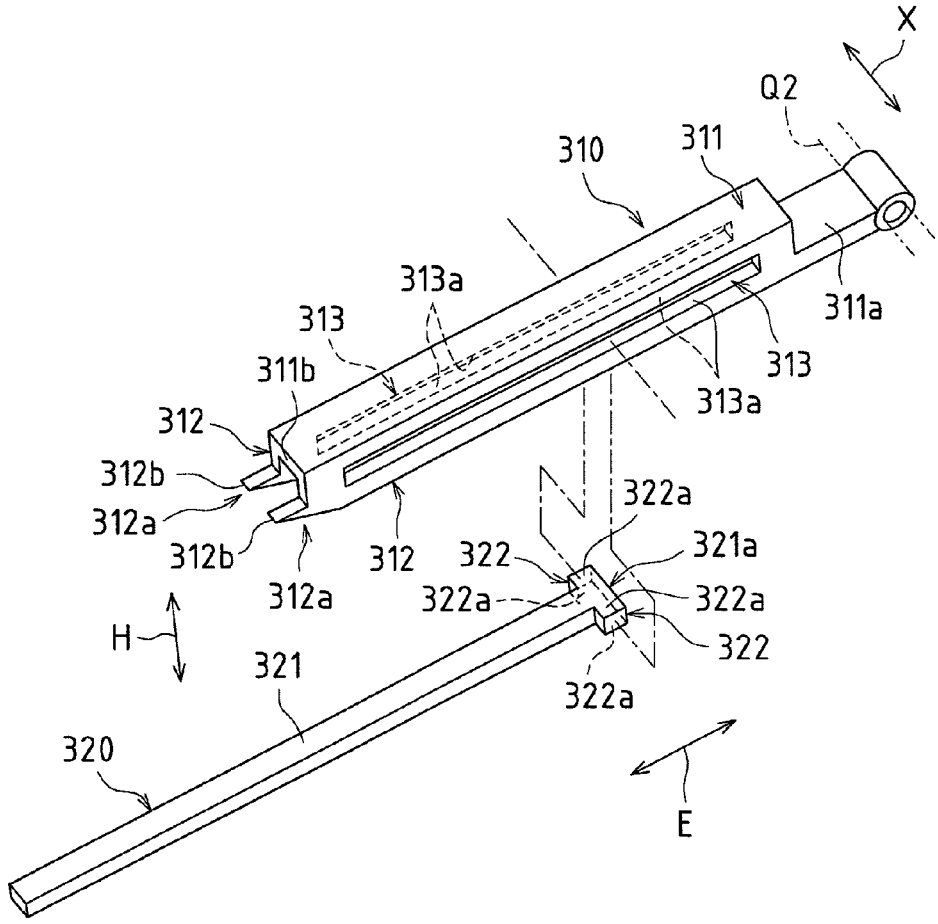
FIG. 12 is a perspective view of the sheet pressing guide according to the second embodiment shown in FIGS. 11A to 11C.

FIGS. 11A to 11C are schematic side views, seen from the shift direction X, of a second embodiment wherein the forward end of the sheet pressing guide 300 is retractably extendable. FIG. 11A shows a situation in which no paper P is loaded on the discharge tray 91. FIG. 11B shows a situation in which B5 size paper P is stacked on the discharge tray 91. FIG. 11C shows a situation in which B4 size paper P is stacked on the discharge tray 91. FIG. 12 is a perspective view of the sheet pressing guide 300 according to the second embodiment shown in FIGS. 11A to 11C.

With the retractably extendable forward end of the sheet pressing guide 300, the sheet pressing guide 300 with a shortened forward end is able to contact the forward edge P1 of a piece of paper P of a short size in the conveyance direction Y1 (for example, B5 size) at the forward edge P1 (see FIG. 11B). Additionally, the bottom face 301 of the sheet pressing guide 300 with an elongated forward end is able to contact a piece of paper P of a long size in the conveyance direction Y1 (for example, B4 size) at the forward edge P1 (see FIG. 11C). Consequently, even when multiple different sizes of paper P are used, the sheet pressing guide 300 is able to contact the forward edge P1 of the topmost piece P0 of varying sizes of paper P.

More specifically, the sheet pressing guide 300 is swingable in the vertical direction Z relative to the discharge roller shift unit 30. In this case, the sheet pressing guide 300 includes a swinging portion 310 that is rotatable about an axis oriented in the shift direction X, and an extension portion 320 that is slidable in the direction of extension and retraction (the direction of the arrow E in FIGS. 11A to 11C) relative to the swinging portion 310.

As shown in FIG. 12, the swinging portion 310 includes a support 311 and guides 312. The support 311 has a rear end 311*a* that is rotatable about a rotation shaft Q2 that is provided on the discharge roller shift unit 30 and oriented in the shift direction X. The guides 312 are supported by the support 311 and guide the extension portion 320 in the direction of extension and retraction E, so as to allow reciprocation of the extension portion 320. In this case, the swinging portion 310 and the extension portion 320 are made from a resin material. The support 311 and the guides 312 are integrated as a single body.

Specifically, the support 311 has a top plate 311*b* extending above the guides 312 to cover the tops of the guides 312. The guides 312 form a pair and are disposed upright on the lower face of the top plate 311*b* at both edges thereof in the shift direction X. The extension portion 320 includes an extension portion main body 321 that is elongated in the direction of extension and retraction E, and protrusions 322 disposed on the extension portion main body 321. The protrusions 322 protrude outwardly on both sides in the shift direction X of a rear end terminal portion 321*a* of the extension portion main body 321. The guides 312 have guide grooves or guide through holes (guide through holes in the example shown in the drawing) 313 through which the protrusions 322 of the extension portion 320 are inserted and guided in the direction of extension and retraction E.

More specifically, the guide grooves or guide through holes 313 each have slide contact faces 313*a* extending in the direction of extension and retraction E on the two inner sides of each of the guide grooves or guide through holes 313 in the thickness direction (the direction indicated by the arrow H in FIG. 12). Furthermore, the protrusions 322 each have slide faces 322*a* extending in the direction of extension and retraction E on the both outer sides of each of the protrusions 322 in the thickness direction H, so as to make sliding contact with the slide contact faces 313*a*. Thus, by sliding the slide faces 322*a* of the protrusions 322 on the slide contact faces 313*a* of the guide grooves or guide through holes 313 of the guides 312, the extension portion 320 slides in the direction of extension and retraction E relative to the swinging portion 310 while maintaining the orientation of the extension portion 320 in the direction of extension and retraction E.

In this example, the sheet pressing guide 300 has a height difference between the bottom face of the swinging portion 310 and the bottom face of the extension portion 320. For this reason, with a view to ensuring that the sheet pressing guide 300 reliably contacts the forward edge P1 of the topmost piece P0 of paper P, in this case, a lower face 312*b* of a tip 312*a* of the guides 312 is inclined inward in the thickness direction H (upward) toward the forward end.

The forward end of the sheet pressing guide 300 may be adjustable in accordance with the size of the piece of paper P discharged onto the discharge tray 91. Specifically, one of the swinging portion 310 and the extension portion 320 may have scale markings (not shown) for each size, such as A4 and B5, while the other one of the swinging portion 310 and the extension portion 320 may have a mark such as an arrow (not shown) pointing to the scale markings. Thus, the forward end of the sheet pressing guide 300 is adjustable according to the size of the piece of paper P. Consequently, when multiple different sizes of sheets are used, a user is able to understand to what extent the sheet pressing guide 300 should be extended or retracted for any of the sizes of paper P, which allows for a corresponding increase in convenience.

Combination of First Embodiment and Second Embodiment

It is possible to combine the configuration in the first embodiment shown in FIGS. 9A to 9C and 10A to 10C, wherein a penetration portion 91*b* is disposed in the discharge tray 91, and the configuration of the second embodiment shown in FIGS. 11A to 11C and 12, wherein the forward end of the sheet pressing guide 300 is retractably expandable.

Figure 13A:
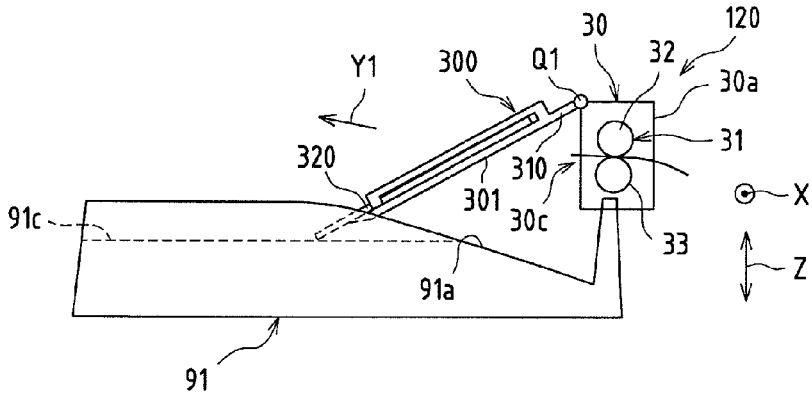
FIGS. 13A to 13C are schematic side views, seen from the shift direction, of the sheet sorter illustrating a penetration portion disposed in the discharge tray with the forward end of the sheet pressing guide retractably extendable.
Figure 13B:
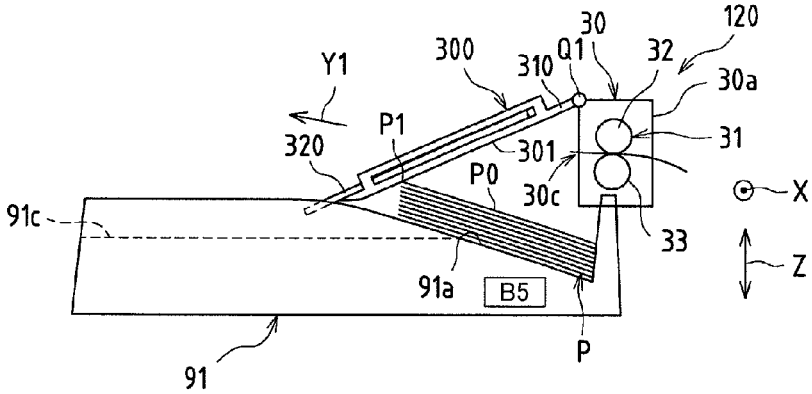
Figure 13C:
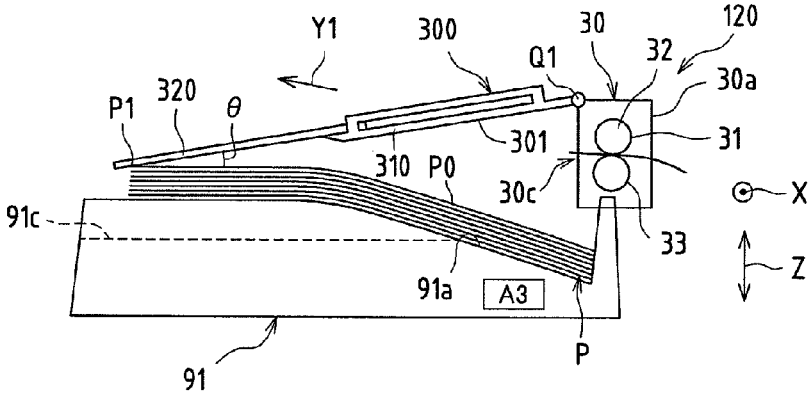

FIGS. 13A to 13C are schematic side views, seen from the shift direction X, of the sheet sorter 120 illustrating a penetration portion 91*c* disposed in the discharge tray 91 with the forward end of the sheet pressing guide 300 retractably extendable. FIG. 13A shows a situation in which no paper P is loaded on the discharge tray 91. FIG. 13B shows a situation in which B5 size paper P is stacked on the discharge tray 91. FIG. 13C shows a situation in which A3 size paper P is stacked on the discharge tray 91.

In the example shown in FIGS. 13A to 13C, the penetration portion 91*c* is disposed through to the downstream end of the discharge tray 91 in the conveyance direction Y1.

Providing a penetration portion 91*c* in the discharge tray 91 in the configuration wherein the forward end of the sheet pressing guide 300 is retractably extendable, as shown in FIGS. 13A to 13C, supports an even wider size range (for example, a size range as wide as B5 size to A3 size).

Incidentally, when multiple different sizes of paper P are used, an angle θ formed between the sheet pressing guide 300 and a piece of paper P (see FIG. 13C) becomes smaller as the piece of paper P is longer in the conveyance direction Y1, or as the rear end of the sheet pressing guide 300 (specifically, the rotation shaft Q1 at the rear end) is closer to the piece of paper P. This leads to a situation in which the sheet pressing guide 300 is likely to make contact with the top face of the piece P0 of paper adjacent to the forward edge P1, depending on the conditions at the forward edge P1 of the topmost piece P0 of paper P.

In view of this situation, the sheet sorter 120 according to the embodiment may be configured as in a third embodiment.

Third Embodiment

In the third embodiment, the sheet pressing guide 300 includes a swinging portion 330 that is disposed on the discharge roller shift unit 30 and rotatable about an axis oriented in the shift direction X; and an extension portion 320 that is slidable in the direction of extension and retraction E relative to the swinging portion 330 and that forms a changeable angle ϕ1 in the vertical direction Z relative to the swinging portion 330.

Figure 14A:
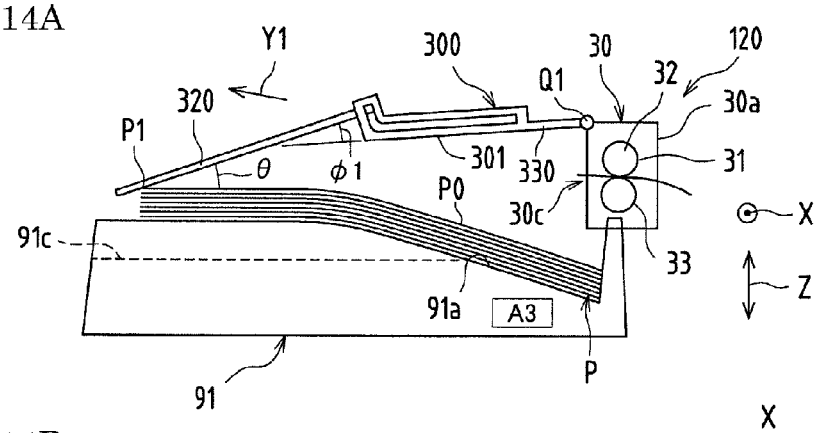
FIGS. 14A to 14C illustrate a third embodiment wherein an extension portion of the sheet pressing guide is slidable in the direction of extension and retraction relative to a swinging portion and forms a changeable angle in the vertical direction relative to the swinging portion.
Figure 14B:
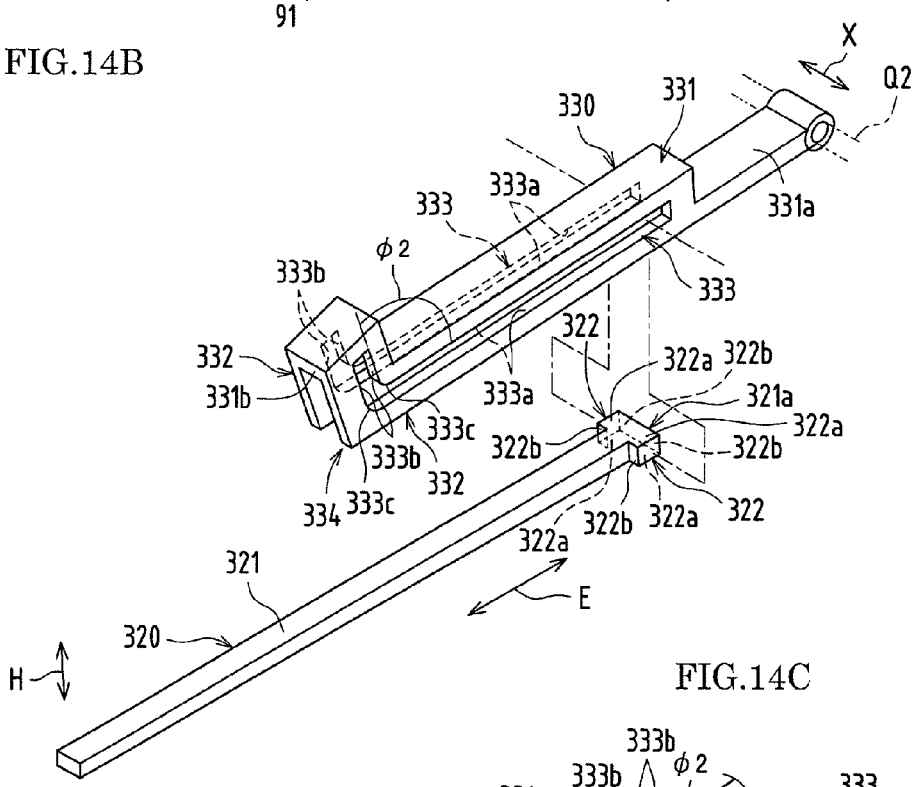
Figure 14C:
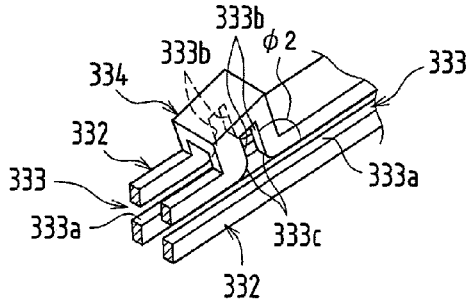
Figure 15A:
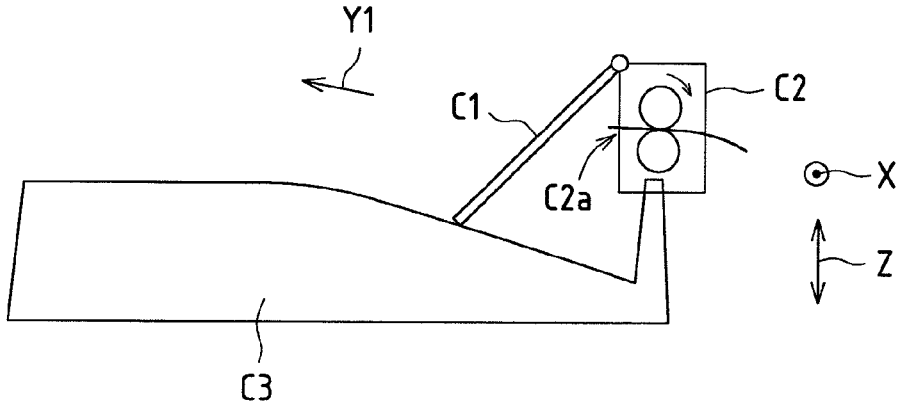
FIG.15A Prior Art
FIGS. 15A to 15C are schematic side views, seen from the shift direction, of a conventional sheet sorter in which a sheet pressing guide is disposed on the sheet conveyance unit and contacts the top face of sheets loaded on the sheet discharge tray.
Figure 15B:
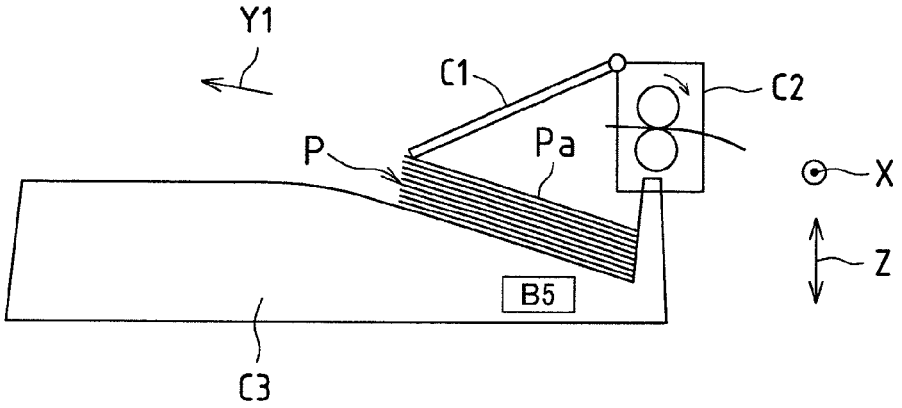
FIG.15B Prior Art
Figure 15C:
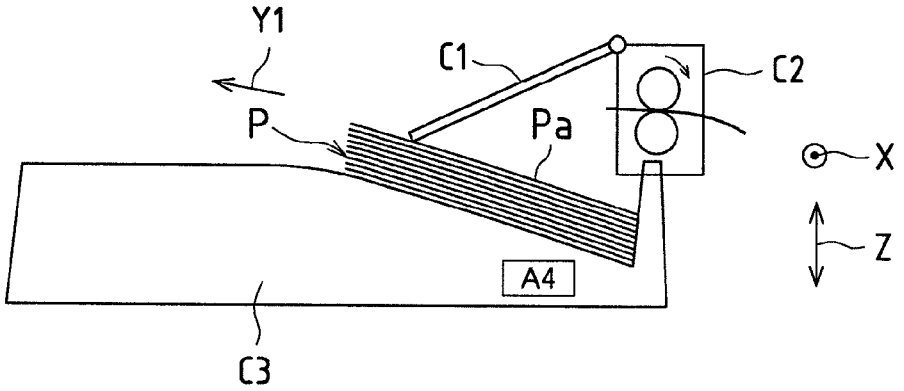
FIG.15C Prior Art
Figure 16A:
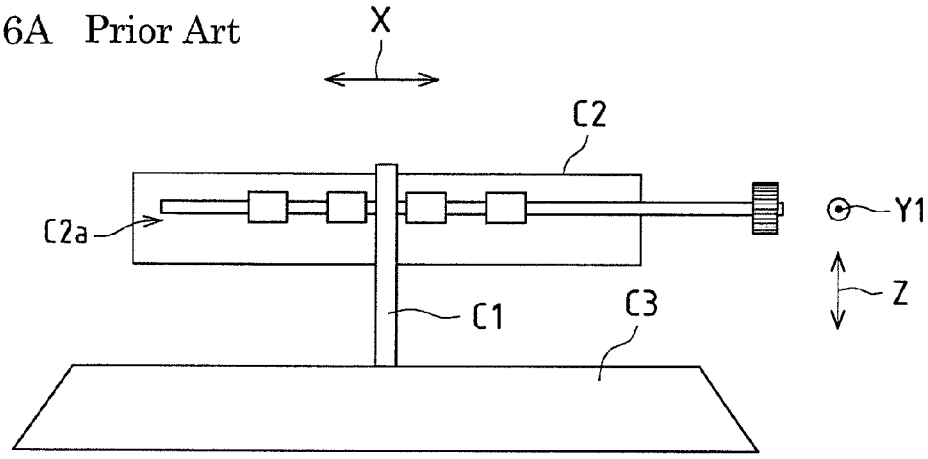
FIG.16A Prior Art
FIGS. 16A to 16C are schematic side views, seen from the conveyance direction, of the conventional sheet sorter in which the sheet pressing guide is disposed on the sheet conveyance unit and contacts the top face of the sheets loaded on the sheet discharge tray.
Figure 16B:
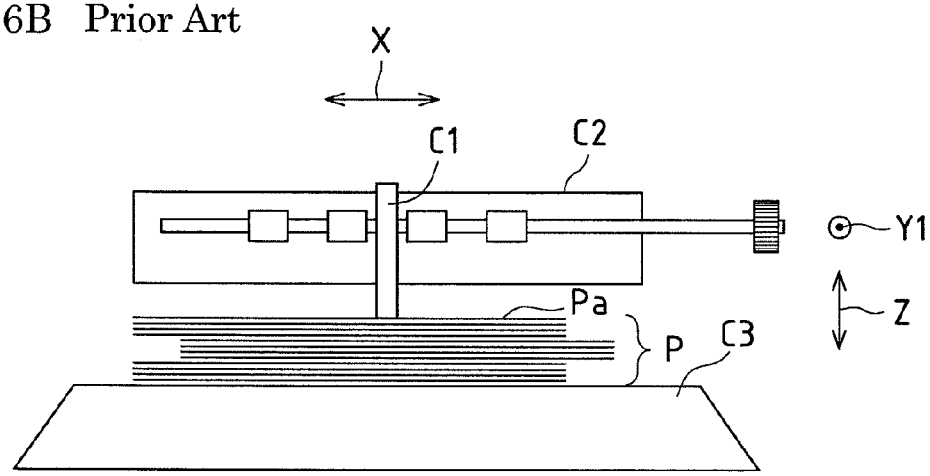
FIG.16B Prior Art
Figure 16C:
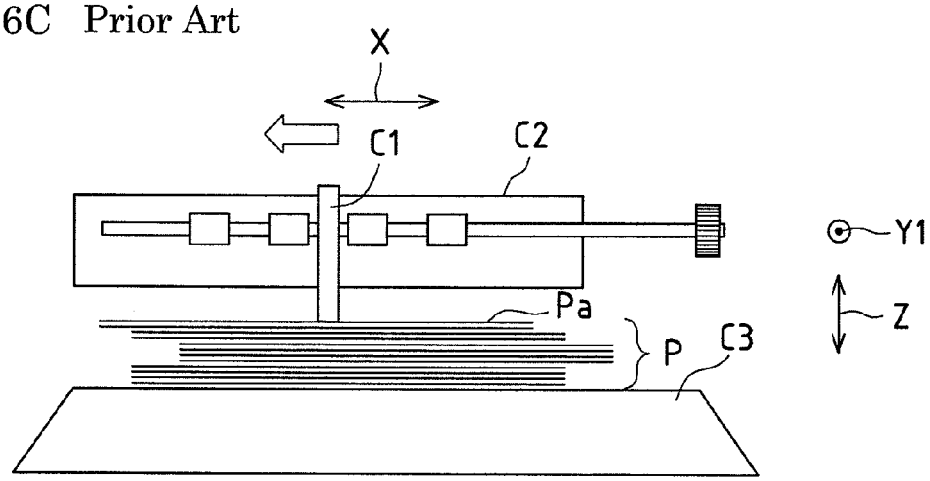
FIG.16C Prior Art

FIGS. 14A to 14C illustrate a third embodiment wherein the extension portion 320 of the sheet pressing guide 300 is slidable in the direction of extension and retraction E relative to the swinging portion 330 and forms a changeable angle ϕ1 in the vertical direction Z relative to the swinging portion 330. FIG. 14A is a schematic side view, seen from the shift direction X, of the third embodiment. FIG. 14B is a perspective view of the sheet pressing guide 300 according to the third embodiment shown in FIG. 14A. FIG. 14C is a perspective view of the swinging portion 330 illustrating a configuration in which an angle changing portion 334, which is shown in FIG. 14B, is disposed along the swinging portion 330. It is noted that like reference numerals designate corresponding or identical elements throughout FIGS. 14A to 14C, which illustrate the third embodiment, and FIGS. 11A to 11C and FIG. 12, which illustrate the second embodiment, and these elements will not be described here.

As shown in FIGS. 14A to 14C, the extension portion 320 of the sheet pressing guide 300 is slidable in the direction of extension and retraction E relative to the swinging portion 330, and fauns a changeable angle ϕ1 in the vertical direction Z relative to the swinging portion 330. Consequently, even when multiple different sizes of paper P are used, the sheet pressing guide 300 is able to contact the forward edge P1 of the topmost piece P0 of varying sizes of paper P. Additionally, even if the angle θ formed between the sheet pressing guide 300 and the piece of paper P becomes small (see FIG. 13C), the user can change (increase) the angle θ in the vertical direction Z relative to the swinging portion 330 (see FIG. 14A), thereby ensuring the contact between the sheet pressing guide 300 and the forward edge P1 of the piece of paper P, even with a piece of paper P of a long size in the conveyance direction Y1 (for example, A3 size).

More specifically, the swinging portion 330 includes a support 331 and guides 332 having the angle changing portion 334. The support 331 has a rear end 331*a* that is rotatable about a rotation shaft Q2 that is provided on the discharge roller shift unit 30 and oriented in the shift direction X. The guides 332 are supported by the support 331 and guide the extension portion 320 reciprocatably in the direction of extension and retraction E. Additionally, the guides 332 guide the extension portion 320 reciprocatably in a direction that intersects the direction of extension and retraction E at the angle changing portion 334 (in this case, an angle changing portion disposed at the forward end) and that is orthogonal to the shift direction X. In this case, the swinging portion 330 and the extension portion 320 are made from a resin material. The support 331 and the guides 332 are integrated as a single body.

Specifically, the support 331 has a top plate 331*a* extending above the guides 332, which have the angle changing portion 334, to cover the tops of the guides 332. The guides 332 form a pair and are disposed upright on the lower face of the top plate 331*b* at both edges thereof in the shift direction X. The guides 332 have guide grooves or guide through holes (guide through holes in the example shown in the drawing) 333 through which the protrusions 322 of the extension portion 320 are inserted and guided in the direction of extension and retraction E and in the direction that intersects the direction of extension and retraction E at the angle changing portion 334 and that is orthogonal to the shift direction X.

More specifically, the guide grooves or guide through holes 333 have first slide contact faces 333*a* extending in the direction of extension and retraction E on the both inner sides in the thickness direction H, and second slide contact faces 333*b* provided in a direction that intersects the direction of extension and retraction E and is orthogonal to the shift direction X. Furthermore, the protrusions 322 each have first slide faces 322*a* and second sliding faces 322*b*. The first slide faces 322*a* is disposed on the both outer sides of the protrusions 322 in the thickness direction H and extend in the direction of extension and retraction E to make sliding contact with the second slide contact faces 333*a*. The second sliding faces 322*b* is disposed on the both outer sides of the protrusions 322 in the direction of extension and retraction E and extend in the thickness direction H to make sliding contact with the second slide contact faces 333*b*. Thus, by sliding the first slide faces 322*a* of the protrusions 322 on the first slide contact faces 333*a* of the guide grooves or guide through holes 313 of the guides 312, the extension portion 320 slides relative to the swinging portion 310 in the direction of extension and retraction E while maintaining the orientation of the extension portion 320 in the direction of extension and retraction E. Meanwhile, by sliding the second sliding faces 322*b* on the second slide contact faces 333*b*, the extension portion 320 slides at the angle changing portion 334 in the direction that intersects the direction of extension and retraction E and is orthogonal to the shift direction X while changing the angle ϕ1 in the vertical direction Z of the extension portion 320 relative to the swinging portion 330 (see FIG. 14A). It is noted that the swinging portion 330 dangles under its own weight, the protrusions 322, which serve as pivots for the extension portion 320 in the angle changing portion 334, rotate upward about an axis oriented in the shift direction X in the angle changing portion 334. This ensures that the protrusions 322 are held in the angle changing portion 334. Consequently, the protrusions 322 are prevented from slipping down in the angle changing portion 334.

With this configuration, establishing an angle ϕ2 formed by the first slide contact face 333*a* and the second slide contact face 333*b* (see FIG. 14B) ensures that the angle ϕ1 of the extension portion 320 in the vertical direction Z relative to the swinging portion 330 (see FIG. 14A) is established, and consequently the angle θ formed between the sheet pressing guide 300 and the piece of paper P (see FIG. 14A) is established.

With a view to causing the protrusions 322 of the extension portion 320 to slide smoothly on the first and second slide contact faces 333*a* and 333*b*, a curved face is disposed at the corner 333*c* between the first slide contact face 333*a* and the second slide contact face 333*b*.

In the third embodiment, as shown in FIG. 14A and FIG. 14B, the angle changing portion 334 of the sheet pressing guide 300 is disposed at the forward end of the swinging portion 330, so that the angle θ in the vertical direction Z is automatically changed according to the degree of maximal extension when the extension portion 320 is maximally extended. Automatically changing the angle θ in the vertical direction Z when the extending part 320 of the sheet pressing guide 300 is maximally extended frees the user of adjustment of the angle θ in the vertical direction Z when the extension portion 320 is extended.

In the third embodiment, the angle changing portion 334 of the sheet pressing guide 300 is disposed at the forward end of the swinging portion 330, and the angle θ in the vertical direction Z is automatically changed in accordance with the degree of maximal extension when the extension portion 320 is maximally extended. Alternatively, as shown in FIG. 14C, the sheet pressing guide 300 may include one or more angle changing portions 334 along the swinging portion 330 in accordance with the length of the piece of paper P in the conveyance direction Y1, so as to change the angle θ in accordance with the degree of extension of the extension portion 320. This ensures that the angle ϕ2 between the first slide contact face 333*a* and the second slide contact face 333*b* is established so as to increase the angle ϕ1 in the vertical direction Z of the extension portion 320 relative to the swinging portion 330 in accordance with increases in the length in the conveyance direction Y1 of the piece of paper P discharged onto the discharge tray 91.

In the third embodiment shown in FIGS. 14A to 14C, a penetration portion 91*c* similar to the penetration portion 91*c* disposed in the discharge tray 91 shown in FIGS. 13A to 13C is provided. The third embodiment may also be applied to a configuration without the penetration portion 91*c*.

Obviously, numerous modifications and variations of the present invention are possible in light of the above teachings. It is therefore to be understood that within the scope of the appended claims, the invention may be practiced otherwise than as specifically described herein.

What is claimed is:

1. A sheet sorter, comprising:

a sheet discharge tray;

a sheet conveyance unit configured to convey sheets in a conveyance direction and configured to be shifted in a shift direction extending along a sheet plane and intersecting the conveyance direction, so as to sort the sheets loaded onto the sheet discharge tray from the sheet conveyance unit; and a sheet pressing guide configured to contact and press the sheets, configured to move together with the sheet conveyance unit in conjunction with the sheet conveyance unit moving in the shift direction, and configured to contact a topmost sheet among the sheets loaded on the sheet discharge tray only at a downstream edge of the topmost sheet in the conveyance direction, wherein the sheet pressing guide has a forward end and a rear end in the conveyance direction, wherein the rear end of the sheet pressing guide is disposed so that the sheet pressing guide is swingable in a vertical direction relative to the sheet conveyance unit and so that the forward end of the sheet pressing guide dangles toward the sheet discharge tray under a weight of the sheet pressing guide itself, and wherein the sheet discharge tray comprises a penetration portion configured to allow the forward end of the sheet pressing guide to penetrate into the sheet discharge tray below a loading face of the sheet discharge tray on which the sheets are loaded.

2. The sheet sorter according to claim 1, wherein the penetration portion comprises a groove or a through hole in the loading face of the sheet discharge tray, the at least one of the groove and the through hole extending in the conveyance direction.

3. The sheet sorter according to claim 2, wherein the groove or the through hole has a width in the shift direction, the width being greater than an amount of shift of the sheet conveyance unit plus a width of the forward end of the sheet pressing guide in the shift direction.

4. The sheet sorter according to claim 3, wherein the forward end of the sheet pressing guide is retractably extendable.

5. The sheet sorter according to claim 4, wherein the forward end of the sheet pressing guide is adjustable according to a size of a sheet discharged onto the sheet discharge tray.

6. The sheet sorter according to claim 2, wherein the forward end of the sheet pressing guide is retractably extendable.

7. The sheet sorter according to claim 6, wherein the forward end of the sheet pressing guide is adjustable according to a size of a sheet discharged onto the sheet discharge tray.

8. The sheet sorter according to claim 1, wherein the forward end of the sheet pressing guide is retractably extendable.

9. The sheet sorter according to claim 8, wherein the forward end of the sheet pressing guide is adjustable according to a size of a sheet discharged onto the sheet discharge tray.

10. An image forming apparatus comprising:

the sheet sorter according to claim 3.

11. A sheet sorter comprising:

a sheet discharge tray;

a sheet conveyance unit configured to convey sheets in a conveyance direction and configured to be shifted in a shift direction extending along a sheet plane and intersecting the conveyance direction, so as to sort the sheets loaded onto the sheet discharge tray from the sheet conveyance unit; and a sheet pressing guide configured to contact and press the sheets, configured to move together with the sheet conveyance unit in conjunction with the sheet conveyance unit moving in the shift direction, and configured to contact a topmost sheet among the sheets loaded on the sheet discharge tray only at a downstream edge of the topmost sheet in the conveyance direction, wherein the sheet pressing guide has a forward end and a rear end in the conveyance direction, wherein the rear end of the sheet pressing guide is disposed so that the sheet pressing guide is swingable in a vertical direction relative to the sheet conveyance unit and so that the forward end of the sheet pressing guide dangles toward the sheet discharge tray under a weight of the sheet pressing guide itself, and wherein the forward end of the sheet pressing guide is retractably extendable.

12. The sheet sorter according to claim 11, wherein the forward end of the sheet pressing guide is adjustable according to a size of a sheet discharged onto the sheet discharge tray.

13. The sheet sorter according to claim 12, wherein the sheet pressing guide comprises a swinging portion swingable in the vertical direction relative to the sheet conveyance unit, and an extension portion slidable in a direction of extension and retraction relative to the swinging portion, the extension portion forming a changeable angle in the vertical direction relative to the swinging portion.

14. The sheet sorter according to claim 13, wherein the angle of the sheet pressing guide in the vertical direction is automatically changed when the extension portion is extended.

15. The sheet sorter according to claim 11, wherein the sheet pressing guide comprises a swinging portion swingable in the vertical direction relative to the sheet conveyance unit, and an extension portion slidable in a direction of extension and retraction relative to the swinging portion, the extension portion forming a changeable angle in the vertical direction relative to the swinging portion.

16. The sheet sorter according to claim 15, wherein the angle of the sheet pressing guide in the vertical direction is automatically changed when the extension portion is extended.

17. An image forming apparatus comprising:

the sheet sorter according to claim 11.

* * * * *

UNITED STATES PATENT AND TRADEMARK OFFICE

CERTIFICATE OF CORRECTION

PATENT NO. : 8,485,523 B2
APPLICATION NO. : 13/216858
DATED : July 16, 2013
INVENTOR(S) : Masaharu Kimura et al.

It is certified that error appears in the above-identified patent and that said Letters Patent is hereby corrected as shown below:

IN THE CLAIMS:

In claim 10, at column 22, line 56, change "according to claim 3" to --according to claim 1--.

Signed and Sealed this
Twelfth Day of November, 2013

Teresa Stanek Rea
*Deputy Director of the United States Patent and Trademark Office*